US011430383B2

(12) United States Patent
Miyata

(10) Patent No.: US 11,430,383 B2
(45) Date of Patent: Aug. 30, 2022

(54) LIGHT EMITTING DEVICE, DISPLAY DEVICE, AND LED DISPLAY DEVICE

(71) Applicant: SHARP KABUSHIKI KAISHA, Sakai (JP)

(72) Inventor: Hidekazu Miyata, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/522,328

(22) Filed: Nov. 9, 2021

(65) Prior Publication Data

US 2022/0189382 A1 Jun. 16, 2022

Related U.S. Application Data

(60) Provisional application No. 63/124,291, filed on Dec. 11, 2020.

(51) Int. Cl.

| | |
|---|---|
| ***G09G 3/32*** | (2016.01) |
| ***G09G 3/34*** | (2006.01) |
| *G09G 3/36* | (2006.01) |

(52) U.S. Cl.

CPC ..... *G09G 3/32* (2013.01); *G09G 3/3426* (2013.01); *G09G 3/36* (2013.01); *G09G 2300/0842* (2013.01); *G09G 2310/08* (2013.01); *G09G 2320/0233* (2013.01)

(58) Field of Classification Search

CPC ... G09G 2320/0626; G09G 2320/0233; G09G 2320/0247; G09G 2320/0242; G09G 2320/043; G09G 2320/045; G09G 2320/103; G09G 2360/16; G09G 3/3233; G09G 3/20; G09G 3/3406; G09G 3/3208; G09G 2330/021; G09G 2310/0243

See application file for complete search history.

(56) References Cited

U.S. PATENT DOCUMENTS

| | | | | |
|---|---|---|---|---|
| 9,576,527 | B2 * | 2/2017 | Han | G09G 3/003 |
| 2014/0062331 | A1 * | 3/2014 | Nam | G09G 3/3233 315/226 |
| 2015/0154906 | A1 * | 6/2015 | Chung | G09G 3/3233 345/212 |
| 2020/0005710 | A1 | 1/2020 | Miyata et al. | |
| 2020/0083260 | A1 * | 3/2020 | Miyake | G09G 3/3291 |
| 2021/0166627 | A1 * | 6/2021 | Xiao | G09G 3/3266 |

FOREIGN PATENT DOCUMENTS

JP 2020-004708 A 1/2020

* cited by examiner

*Primary Examiner* — Dong Hui Liang
(74) *Attorney, Agent, or Firm* — ScienBiziP, P.C.

(57) ABSTRACT

A light-emitting device includes a plurality of area drive circuits. The area drive circuits each include a first write control transistor and a second write control transistor. Each of the area drive circuits has a first write period in which the first and the second write control transistor are maintained in an on state, a first write stop period in which the first and the second write control transistor are maintained in an off state, and a second write period in which the first write control transistor is maintained in the off state and the second write control transistor is maintained in the on state, the periods being provided in this order in one frame period from when the first write control transistor changes from the off state to the on state to when the first write control transistor next changes from the off state to the on state.

9 Claims, 25 Drawing Sheets

LIGHT EMITTING DEVICE, DISPLAY DEVICE, AND LED DISPLAY DEVICE

CROSS-REFERENCE TO RELATED APPLICATION

The present application claims priority from Provisional Application No. 63/124,291, the content to which is hereby incorporated by reference into this application.

BACKGROUND

1. Field

The following disclosure relates to a light-emitting device having an LED as a light source, a display device using the light-emitting device as a backlight, and an LED display device including the light-emitting device.

2. Description of the Related Art

In a transmissive liquid crystal display device, a backlight for illuminating light from a back surface of a display portion (liquid crystal panel) is required for displaying an image. In many cases, a cold cathode tube known as CCFL has been used as a light source for known backlights. However, in recent years, light emitting diodes (LEDs) have been increasingly used due to their features such as low power consumption and easy luminance control. For achieving lower power consumption in liquid crystal display devices such as those described above, a technique known as "local dimming" has been developed. With such a technique, the luminance (light emission intensity) of the LED is controlled for each area. In a direct backlight with which local dimming is performed, as illustrated in FIG. 24, an LED substrate is logically divided into a plurality of areas each of which is provided with an LED unit 95 including one or a plurality of LEDs serving as a light source. The luminance of the LED is controlled for each area. For example, the luminance of each LED is determined based on a maximum value, an average value, and the like of the input gray scale value of the pixels included in the corresponding area.

Incidentally, in recent years, the vigorous development has been conducted on LEDs with an extremely small size compared with conventional LEDs, such as an LED known as "mini LED" and an LED known as "micro LED". In this context, backlights with which local dimming is performed using such micro-sized LEDs are becoming popular. Due to such downsizing of the LEDs, a backlight with the number of areas exceeding 1000 has been developed, and the number of areas is expected to further increase in the future.

A typical backlight with which local dimming is performed in recent years has a circuit configuration in which, for each area, an output terminal of an LED driver and a cathode of an LED are connected. Therefore, as the number of areas increases, the number of wiring lines increases. An increase in the number of areas also leads to an increase in the number of LED drivers required. In view of this, techniques have been developed in which LED active matrix driving is performed using matrix wiring lines. JP 2020-4708 A discloses a technique for suppressing occurrence of display failure such as luminance variations or flickering, in a backlight with which active matrix driving is performed.

In a conventional backlight with which active matrix driving is performed, each area is provided with a circuit portion such as that illustrated in FIG. 25 in which an LED

96 and a drive transistor 97 that controls the current flowing in the LED 96 are connected in series. A MOSFET is used for the drive transistor 97. The LED 96 has an anode terminal connected to a VDD wiring line 98 that supplies high level power supply voltage VDD, and has a cathode terminal connected to the drain terminal of the drive transistor 97. The drive transistor 97 has a drain terminal connected to the cathode terminal of the LED 96, and has a source terminal connected to a VSS wiring line 99 that supplies low level power supply voltage VSS. The gate terminal of the drive transistor 97 is connected to one end of a holding capacitor (not illustrated in FIG. 25). In such a configuration, typically, the data voltage corresponding to a target luminance is written to the holding capacitor for each frame period. As a result, current corresponding to the magnitude of the gate-source voltage of the drive transistor 97 flows to the LED 96, whereby the LED 96 emits light.

However, with the conventional configuration, a luminance reduction may occur in the frame period immediately after a change in the target luminance from a minimum luminance to a maximum luminance (that is, the frame period immediately after a change from a state in which the voltage corresponding to the minimum luminance is written to the holding capacitor to a state in which the voltage corresponding to the maximum luminance is written to the holding capacitor).

SUMMARY

In view of the above, an aspect of the disclosure below is to realize a light-emitting device that can suppress the occurrence of a luminance reduction in a frame period immediately after a sharp increase in a target luminance.

(1) A light-emitting device according to an aspect of the disclosure is a light-emitting device using an LED as a light source, the light-emitting device including:

a plurality of LED units each including one or a plurality of the LEDs, the plurality of LED units being provided, on a substrate logically divided into a plurality of areas, corresponding to the plurality of areas in a one-to-one manner;

a plurality of area drive circuits each configured to drive the LED included in a corresponding one of the LED units, the plurality of area drive circuits being provided corresponding to the plurality of LED units in a one-to-one manner;

a plurality of first write control lines;

a plurality of data lines intersecting with the plurality of first write control lines;

a plurality of second write control lines corresponding to the plurality of first write control lines in a one-to-one manner;

a first power supply line configured to supply a first power supply voltage;

a second power supply line configured to supply a second power supply voltage; and a drive control circuit connected to the plurality of first write control lines, the plurality of second write control lines, and the plurality of data lines, and configured to control an operation of the plurality of area drive circuits such that the LEDs included in the plurality of LED units are driven on a row-by-row basis, in which the area drive circuits each include a drive transistor connected in series to the LED included in the corresponding one of the LED units, between the first power supply line and the second power supply line, a first write control transistor including a control terminal connected to a corresponding one of the first write control lines and including a first conduction terminal connected to a corresponding one of the data lines, a first holding capacitor including one end connected to a second conduction terminal of the first write control transistor and including another end connected to the second power supply line, a second write control transistor including a control terminal connected to a corresponding one of the second write control lines and including a first conduction terminal connected to the one end of the first holding capacitor, and a second holding capacitor including one end connected to a second conduction terminal of the second write control transistor and to a control terminal of the drive transistor and including another end connected to the second power supply line, the drive transistor is a MOSFET, each of the area drive circuits has a first write period in which the first write control transistor and the second write control transistor are both maintained in an on state, a first write stop period in which the first write control transistor and the second write control transistor are both maintained in an off state, and a second write period in which the first write control transistor is maintained in the off state and the second write control transistor is maintained in the on state, the periods being provided in this order in one frame period from a point when the first write control transistor changes from the off state to the on state to a point when the first write control transistor next changes from the off state to the on state.

With such a configuration, the following operations are performed in each frame period in each area drive circuit. First of all, with the first write control transistor and the second write control transistor both being in the on state, the data voltage is written to the first holding capacitor and the second holding capacitor. Next, with the first write control transistor and the second write control transistor both being in the off state, the writing of the data voltage stops. Then, with only the second write control transistor of the first write control transistor and the second write control transistor being in the on state, pseudo rewriting of the data voltage is performed. Thus, even when the luminance temporarily reduces due to the drop in the potential at one end of the second holding capacitor after the data voltage has been written in a case in which the target luminance sharply increases, the luminance increases due to the potential at one end of the second holding capacitor rising as a result of the pseudo rewriting of the data voltage. With the above configuration, the light-emitting device is realized that can suppress the occurrence of a luminance reduction in the frame period immediately after a sharp increase in the target luminance.

(2) The light-emitting device according to an aspect of the disclosure includes the configuration of (1) described above, in which an electrostatic capacitance value of the second holding capacitor is 1/10 of an electrostatic capacitance value of the first holding capacitor or smaller.

(3) The light-emitting device according to an aspect of the disclosure includes the configuration of (1) described above, in which each of the area drive circuits has an end point of the second write period in an earlier one of two consecutive frame periods, and a start point of the first write period of a later one of the two consecutive frame periods, the end point and the start point being same points.

(4) The light-emitting device according to an aspect of the disclosure includes the configuration of (1) described above, in which each of the area drive circuits has a second write stop period in which the first write control transistor and the second write control transistor are both maintained in the off state, provided between an end point of the second write period in an earlier one of two consecutive frame periods and a start point of the first write period of a later one of the two consecutive frame periods.

(5) The light-emitting device according to an aspect of the disclosure includes the configuration of (4) described above, in which, of the first write period, the first write stop period, the second write period, and the second write stop period, the second write stop period has the longest length.

(6) The light-emitting device according to an aspect of the disclosure includes the configuration of (1) described above, in which a length of the first write stop period is equal to or longer than a time required for an inversion layer to be formed in the drive transistor when a voltage applied to the control terminal of the drive transistor is changed from a voltage corresponding to a minimum luminance to a voltage corresponding to a maximum luminance, and a carrier density to become constant in the inversion layer.

(7) The light-emitting device according to an aspect of the disclosure includes the configuration of (1) described above, in which the first write control transistor and the second write control transistor are thin film transistors.

(8) A display device according to an aspect of the disclosure includes:

a display panel including a display portion configured to display an image; and the light-emitting device of any one of the configurations of (1) to (7) described above provided on a back surface of the display panel and configured to illuminate the display portion with light.

(9) An LED display device according to an aspect of the disclosure includes the light-emitting device of any one of the configurations of (1) to (7) described above, in which the plurality of LED units are classified into K types based on colors of light emitted, and each picture element includes the K types of the plurality of LED units.

These and other objects, features, aspects, and advantages of the disclosure will become more apparent from the following detailed description of the disclosure with reference to the accompanying drawings.

DETAILED DESCRIPTION

0. Basic Study

Figure 2:
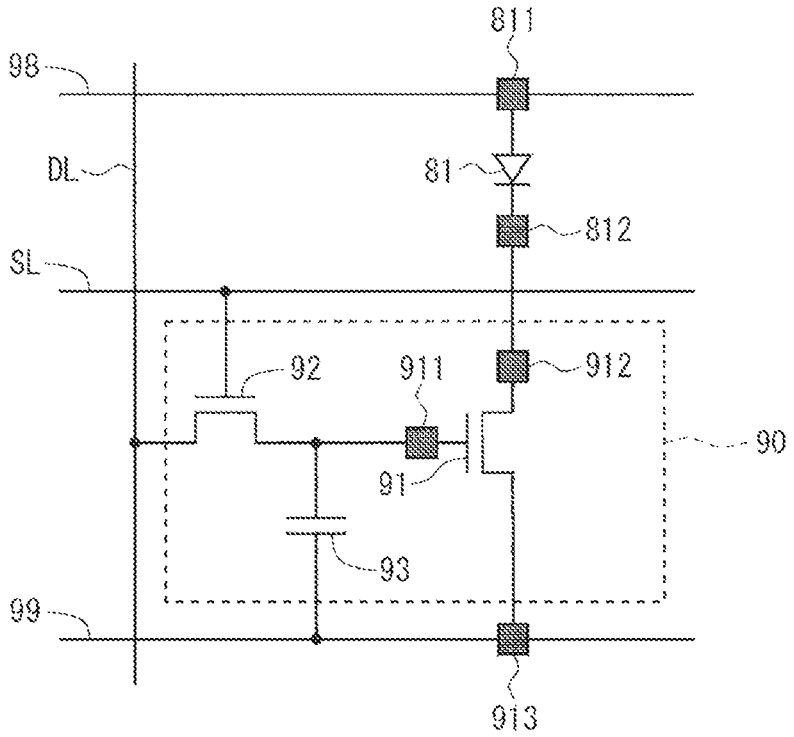
FIG. 2 is a diagram illustrating an example of a circuit configuration for a single area of a backlight performing active matrix driving.

A circuit configuration such as that illustrated in FIG. 2 is a possible circuit configuration for a single area of a backlight performing active matrix driving. In the configuration illustrated in FIG. 2, each area is provided with one LED 81 serving as the LED unit described above and an area drive circuit 90 that drives the LED 81. The area drive circuit 90 includes a drive transistor 91, a write control transistor 92, and a holding capacitor 93. The drive transistor 91 is a MOSFET, and the write control transistor 92 is a TFT. A write control line SL, a data line DL, a VDD wiring line 98, and a VSS wiring line 99 are provided at or near the area drive circuit 90. A write control signal is applied to the write control line SL, and a data voltage is applied to the data line DL. Note that the LED 81 and the drive transistor 91 are provided, as external components, on an LED substrate with a layer structure in which the write control transistor 92, the holding capacitor 93, the write control line SL, the data line DL, the VDD wiring line 98, and the VSS wiring line 99 are formed. Specifically, an anode terminal and a cathode terminal of the LED 81 are respectively connected to pads 811 and 812 formed on the LED substrate. A gate terminal, a drain terminal, and a source terminal of the drive transistor 91 are respectively connected to pads 911, 912, and 913 formed on the LED substrate.

It is assumed below that n areas are provided in an extension direction of the data line DL and m areas are provided in an extension direction of the write control line SL. Thus, it is assumed that n write control lines SL and m data lines DL are provided on the LED substrate. Note that the write control signal is denoted by the same reference sign SL as the write control lines, and the data voltage is denoted by the same reference sign DL as the data lines.

Figure 3:
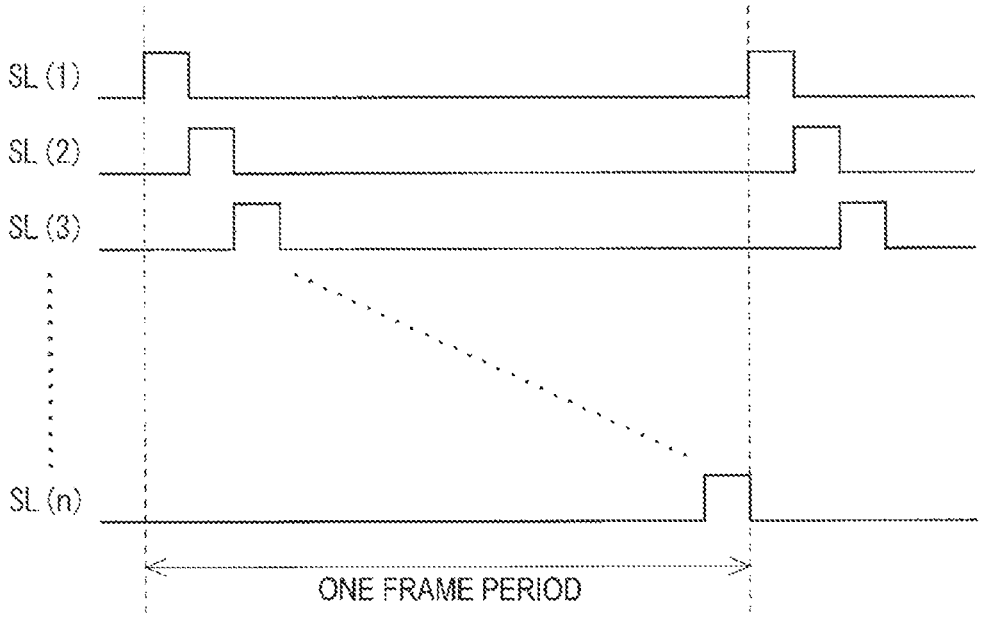
FIG. 3 is a waveform diagram of a write control signal during one frame period.

In the configuration described above, write control signals SL(1) to SL(n), sequentially rising to the high level in each predetermined period as illustrated in FIG. 3, are applied to the n write control lines. As can be understood from FIG. 3, each write control signal SL is at the high level during a period with a length that is 1/n of one frame period, and is maintained at the low level during the remaining period. When the write control signal SL applied to a certain write control line SL rises to the high level, the data voltage DL is written to the holding capacitor 93 via the write control transistor 92 in the area drive circuit 90 corresponding to the write control line SL. In other words, charge corresponding to the data voltage DL is accumulated in the holding capacitor 93. Then, with the write control signal SL dropping to the low level, the data voltage DL written to the holding capacitor 93 is maintained. Thus, during a period until the write control signal SL next changes to the high level, current of a magnitude corresponding to the held data voltage DL flows in the drive transistor 91, and the LED 81 emits light at a luminance corresponding to the magnitude of the current. In this manner, the luminance of the LED 81 in each area is controlled. Here, each write control signals SL rises to the high level only once in one frame period, and thus the luminance of the LED 81 in each area is controlled for each frame period.

Figure 4:
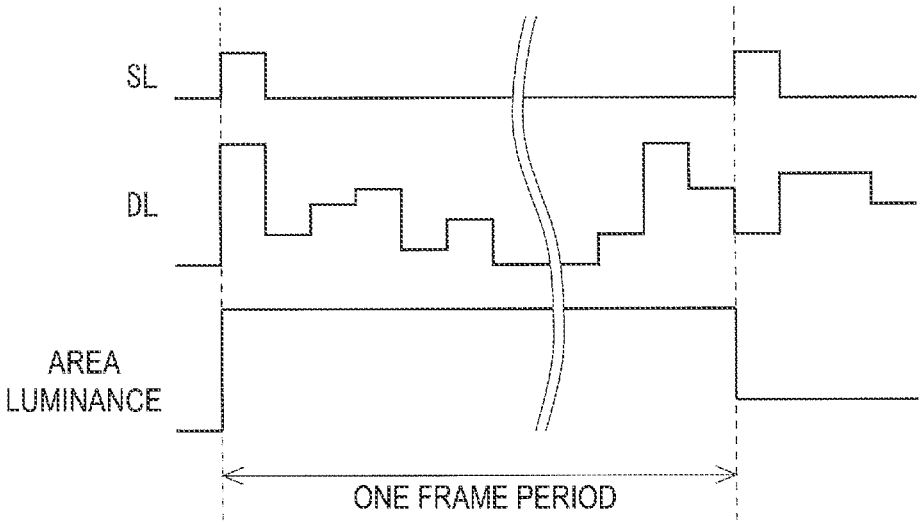
FIG. 4 is a diagram illustrating an example of changes in the write control signal, data voltage, and area luminance corresponding to a certain area.

FIG. 4 illustrates an example of changes in the write control signal SL, the data voltage DL, and area luminance corresponding to a certain area. Note that the area luminance is the brightness per unit area of one area. As can be understood from FIG. 4, when the write control signal SL changes from the low level to the high level, the area luminance changes in accordance with the data voltage DL, and the area luminance is maintained until the point when the write control signal SL next changes from the low level to the high level. Note that although a change in the area luminance due to the writing of the data voltage DL is delayed in a strict sense, but such a delay will be ignored in the following description unless otherwise stated.

Figure 5:
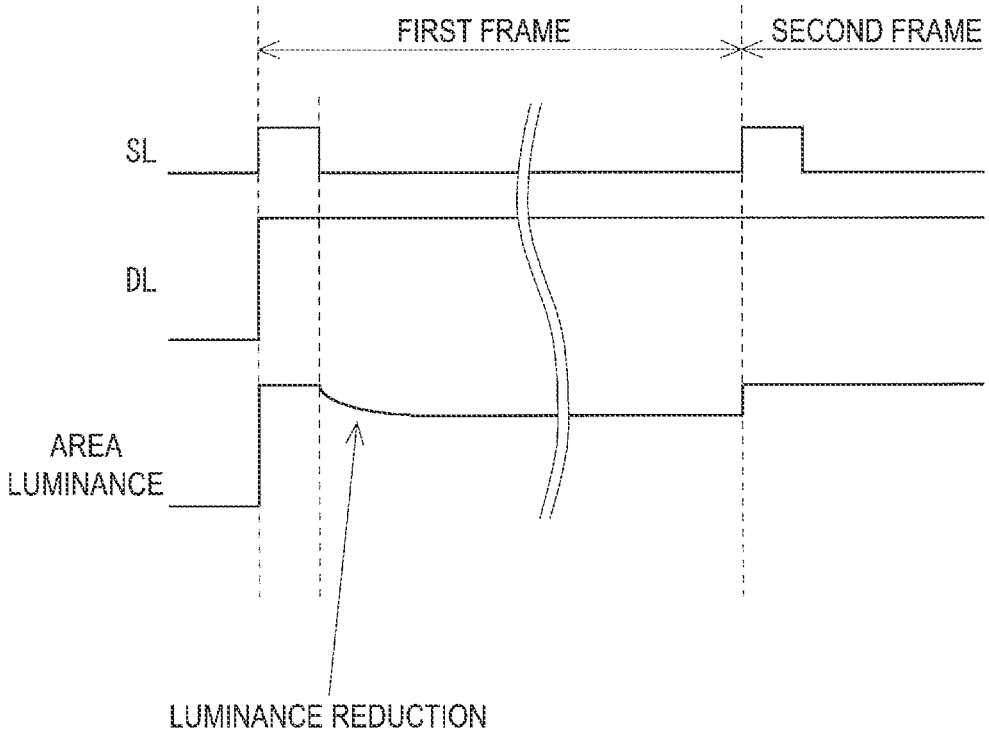
FIG. 5 is a waveform diagram for describing a reduction in the area luminance.

Still, the configuration illustrated in FIG. 2 might involve a phenomenon in which a change in the area luminance from 0 cd/m$^2$ to a certain luminance results in a gradual reduction in the area luminance as illustrated in FIG. 5 in a frame period (referred to as the "first frame") immediately after the luminance change. Such a luminance reduction does not occur in the second frame and thereafter. The phenomenon in which a luminance reduction occurs only in the first frame immediately after the luminance change will be described below. Note that the following description is given with an example case in which an n-channel type MOSFET is used as the drive transistor.

In the n-channel type MOSFET, when the voltage between the gate and the source reaches or exceeds a threshold voltage, electrons accumulate in a boundary portion (interface) for an insulator in a p-type semiconductor, resulting in a p-type semiconductor portion between an n-type semiconductor (drain) and an n-type semiconductor (source) turning into an n-type semiconductor. As a result, current flows between the drain and the source of the MOSFET. Note that the portion that has turned into the n-type semiconductor is referred to as an inversion layer.

In the case in which the target luminance is increased from 0 cd/m$^2$ in the configuration illustrated in FIG. 2, the gate voltage of the drive transistor 91 changes from a value that is equal to or less than the threshold voltage to a value equal to or more than the threshold voltage. At this time, a depletion layer and the inversion layer are formed in the semiconductor constituting the drive transistor 91, and carriers (electrons in this case), the number of which corresponds to the magnitude of the gate voltage, are generated in the inversion layer. Still, the carrier generation and the carrier disappearance are repeated in the inversion layer, meaning that even when the number of carriers temporarily is or higher than a certain number, the number of carriers decreases when the supply of voltage to the gate ends. Such carrier generation and carrier disappearance are repeated until a relaxed state in the inversion layer and the depletion layer is reached. Thus, ideally, the voltage continues to be applied to the gate, until an equilibrium state of the carrier generation and the carrier disappearance is reached. Note that, in the present specification, the time required for the equilibrium state of the carrier generation and the carrier disappearance to be reached after the start point of the voltage application to the gate is referred to as the "carrier activation time", and this relaxed state is referred to as an "activation state".

In the configuration illustrated in FIG. 2, voltage is applied to the gate of the drive transistor 91 via the write control transistor 92 during a period (hereinafter, referred to as "write period") in which the write control transistor 92 is maintained in the on state. When the activation state in the inversion layer is reached during the write period, the luminance reduction as described above does not occur. However, when the write control transistor 92 changes from the on state to the off state before the activation state in the inversion layer is reached, the number of carriers in the inversion layer decreases due to an increase in a carrier disappearance ratio. As a result, the current flowing between the drain and the source of the drive transistor 91 decreases, resulting in a luminance reduction as illustrated in FIG. 5.

Incidentally, leakage between the gate and the source of the drive transistor 91 and leakage between the source and the drain of the write control transistor 92 are possible causes of the luminance reduction. In this context, if the luminance reduction is caused by such leakage, the luminance reduction occurring in the first frame should similarly occur in the second frame and thereafter. However, as illustrated in FIG. 5, the second frame and thereafter are free of the luminance reduction. Insufficient charging of the holding capacitor 93 is another possible cause of the luminance reduction. However, according to the validation result, the gate voltage immediately after the end point of the write period is the same between the first frame and the second frame and thereafter. All things considered, any of the leakage between the gate and the source of the drive transistor 91, the leakage between the source and the drain of the write control transistor 92, and the insufficient charging of the holding capacitor 93 should not be the cause of the luminance reduction described above.

Figure 6:
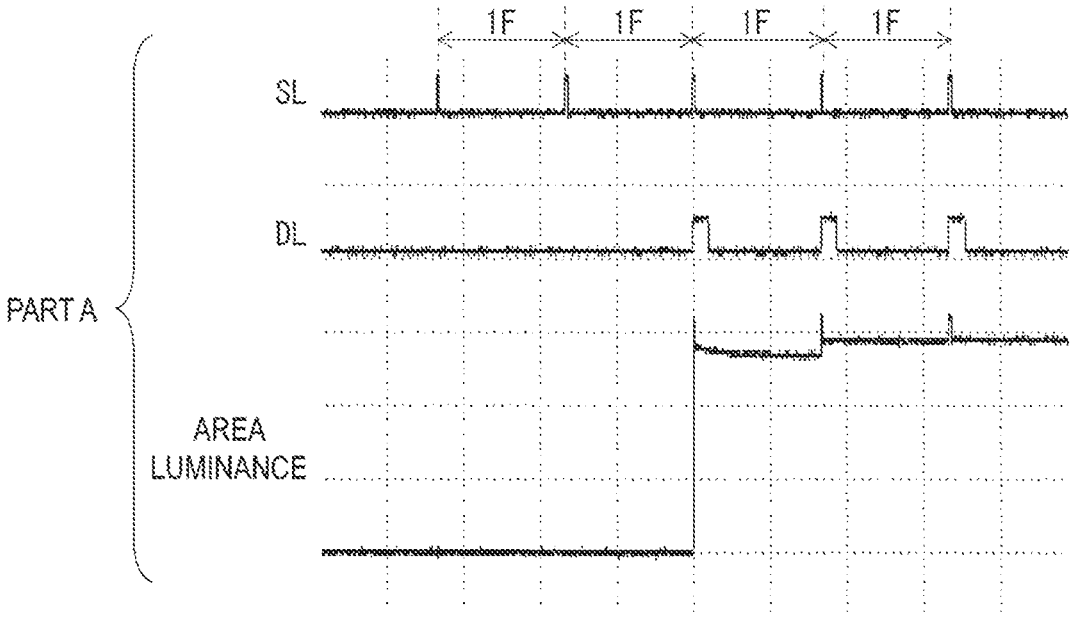
FIG. 6 is a diagram showing experimental results of a case in which the length of one frame period is set to a normal length and a case in which the length of one frame period is set to ½ of the normal length in an example with the area luminance increased from 0 cd/m$^2$.
Figure 6:
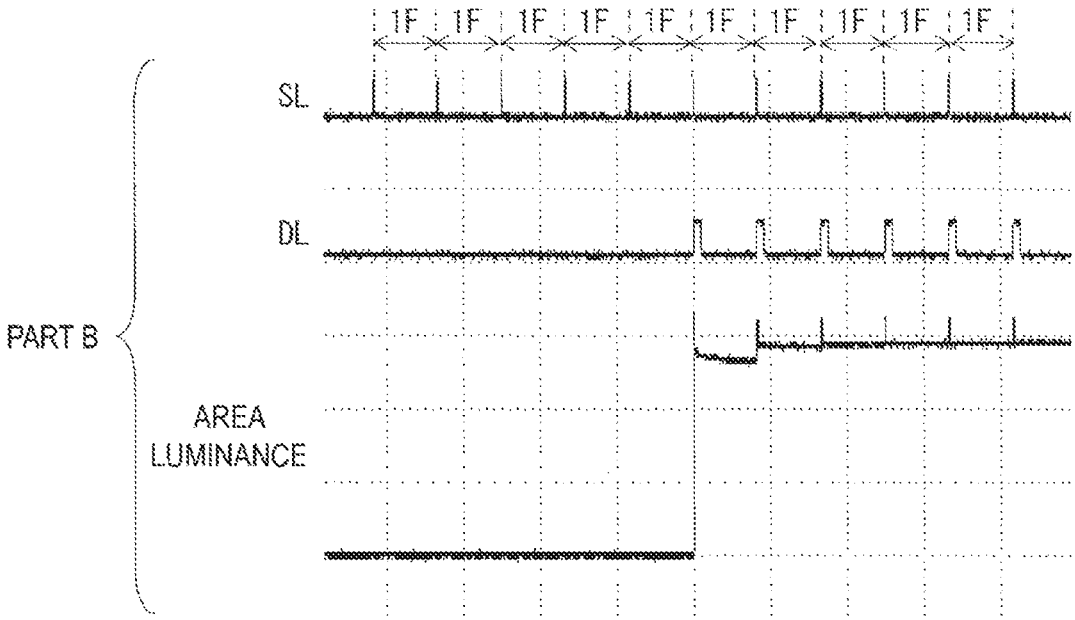

FIG. 6 shows experimental results of a case in which the length of one frame period is set to a normal length and a case in which the length of one frame period is set to ½ of the normal length in an example with the area luminance increased from 0 cd/m$^2$. Part A in FIG. 6 shows the results obtained in the case in which the length of one frame period is set to a normal length, Part B in FIG. 6 shows the results obtained in the case in which the length of one frame period is set to ½ of the normal length. In FIG. 6, an arrow denoted by reference sign IF indicates one frame period in each case. Note that, in the case in which the length of one frame period is set to ½ of the normal length, the length of the write period is also set to ½ of the normal length.

As can be understood from Part B of FIG. 6, also in the case in which the length of one frame period is set to ½ of the normal length, a luminance reduction is occurring in the first frame (the frame period immediately after a change in the luminance) but is not occurring in the second frame and thereafter. This suggests that the cause of a luminance reduction in the case in which the length of one frame period is the normal length is not insufficient charging of the holding capacitor 93. Specifically, the luminance reduction is occurring only in the first frame despite the fact that sufficient charge is accumulated in the holding capacitor 93 in each frame period and voltage is applied sufficiently between the gate and the source of the drive transistor 91. Thus, it is expected that the activation state described above is not yet reached in the inversion layer in the first frame. In addition, the fact that the luminance reduction is not occurring in the second frame and thereafter even though the length of one frame period is shortened indicates that the state in the inversion layer becomes close to the activation state even during a period in which the voltage application to the gate of the drive transistor 91 is off after the write period has ended, and that the carrier activation time is ½ of one frame period or shorter.

From the above, it is expected that the reduced luminance can be increased by applying voltage to the gate of the drive transistor 91 again after the carrier activation time has elapsed from the end point of the write period. An example of a possible approach for doing this includes providing two write periods in one frame period, with the length of the write period set to ½ of the normal length. However, to employ this approach, a component such as a memory for storing data for writing for the second time in each frame period is required.

In view of the above, a description will be given below on an approach for suppressing the luminance reduction in a frame period immediately after a change in the luminance, without using a memory or the like for holding data. Three embodiments will be described below. A first embodiment and a second embodiment are directed to a liquid crystal display device, and a third embodiment is directed to an LED display device.

1. First Embodiment

1.1 Overall Configuration

Figure 7:
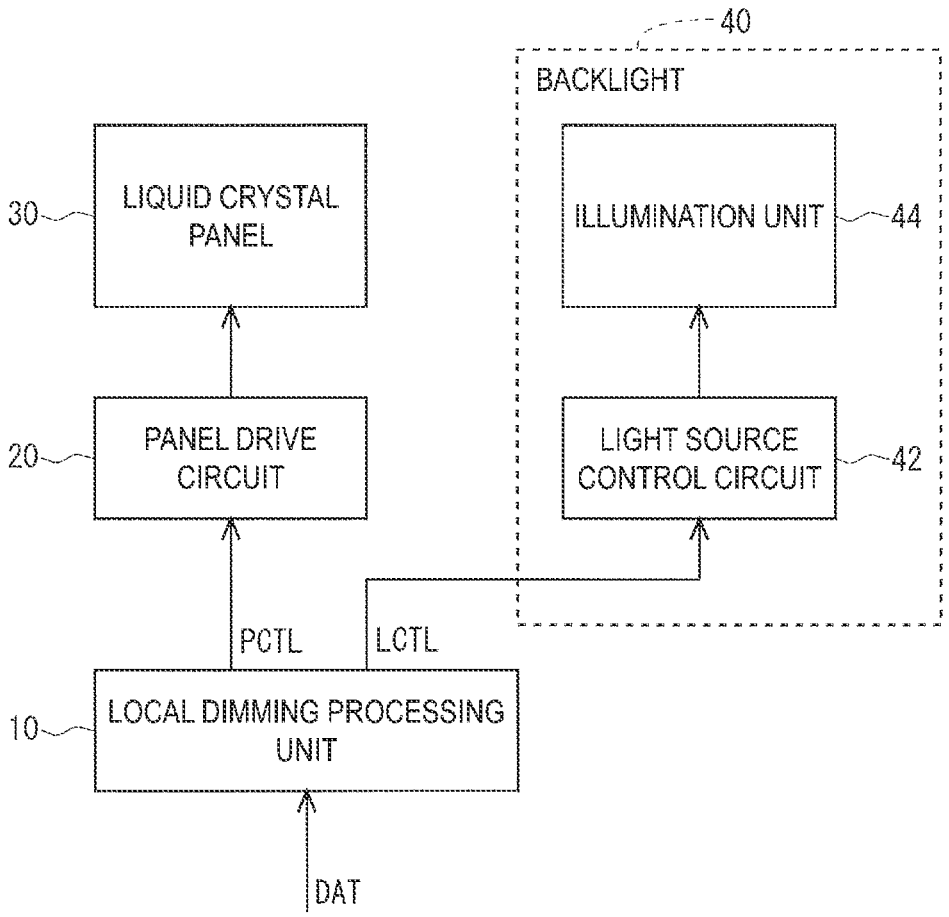
FIG. 7 is a block diagram illustrating an overall configuration of a liquid crystal display device according to the first embodiment.

FIG. 7 is a block diagram illustrating an overall configuration of a liquid crystal display device according to a first embodiment. The liquid crystal display device includes a local dimming processing unit 10, a panel drive circuit 20, a liquid crystal panel 30, and a backlight (light-emitting device) 40. The liquid crystal panel 30 is formed with two opposing glass substrates and includes a display portion that displays an image. The backlight 40 is provided on the back surface of the liquid crystal panel 30. The backlight 40 includes a light source control circuit 42 and an illumination unit 44. The illumination unit 44 includes an LED unit (unit including one or a plurality of LEDs) and an area drive circuit provided on an LED substrate.

Figure 8:
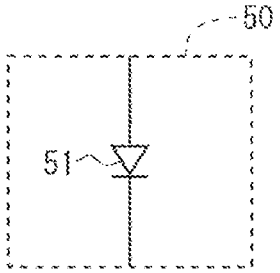
FIG. 8 is a diagram for describing a configuration of an LED unit in the first embodiment.
Figure 9:
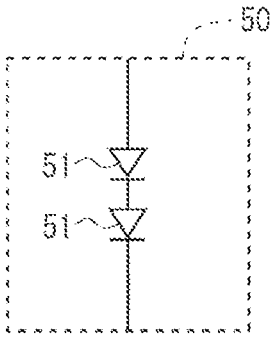
FIG. 9 is a diagram for describing the configuration of the LED unit in the first embodiment.
Figure 10:
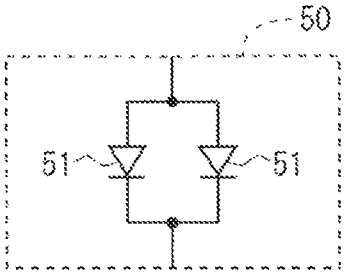
FIG. 10 is a diagram for describing the configuration of the LED unit in the first embodiment.
Figure 11:
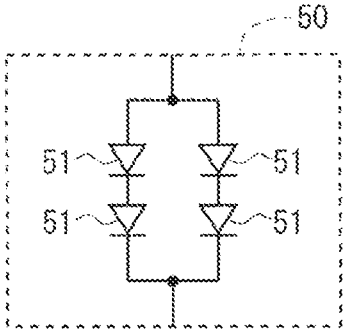
FIG. 11 is a diagram for describing the configuration of the LED unit in the first embodiment.

Note that in the following, the LED unit 50 is assumed to include one LED 51 as illustrated in FIG. 8. However, this should not be construed as a limiting sense, and the LED unit 50 may include a plurality of LEDs 51 connected in series as illustrated in FIG. 9, may include a plurality of LEDs 51 connected in parallel as illustrated in FIG. 10, and may include both LEDs 51 connected in series and LEDs 51 connected in parallel as illustrated in FIG. 11.

Figure 12:
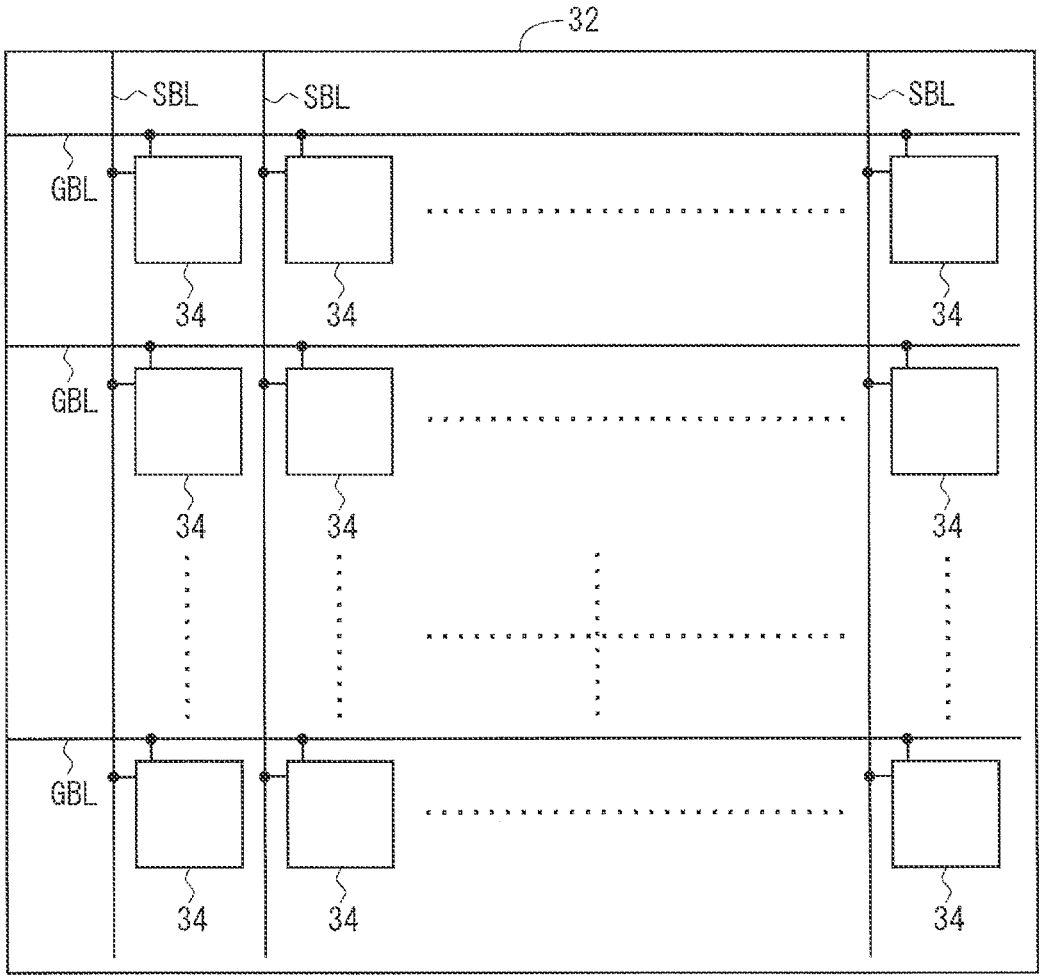
FIG. 12 is a diagram for describing a configuration of a display portion in the first embodiment.

As illustrated in FIG. 12, a plurality of gate bus lines GBL and a plurality of source bus lines SBL are disposed in a display portion 32 in the liquid crystal panel 30. A pixel portion 34 corresponding to each of the intersections between the plurality of gate bus lines GBL and the plurality of source bus lines SBL is provided. Thus, the display portion 32 includes a plurality of the pixel portions 34. The plurality of pixel portions 34 described above are arranged in a matrix shape to form a pixel matrix. Each pixel portion 34 includes a pixel capacitor.

Next, operations of components illustrated in FIG. 7 will be described. The local dimming processing unit 10 receives the image data DAT sent from the outside and outputs a panel control signal PCTL for controlling the operation of the panel drive circuit 20 and a luminance control signal LCTL for controlling the operation of the light source control circuit 42, so that the local dimming (processing for controlling the luminance of the LED 51 for each area) described above is performed. Note that the panel control signal PCTL and the luminance control signal LCTL include a plurality of control signals.

The panel drive circuit 20 drives the liquid crystal panel 30 based on the panel control signal PCTL sent from the local dimming processing unit 10. Specifically, the panel drive circuit 20 includes a gate driver that drives the gate bus line GBL and a source driver that drives the source bus line SBL. When the gate driver drives the gate bus line GBL and the source driver drives the source bus line SBL, the voltage corresponding to a target display image is written to the pixel capacitor in each of the pixel portions 34.

The light source control circuit 42 controls the operation of an area drive circuit described below, so that the LED 51 in the illumination unit 44 emits light at a desired luminance based on the luminance control signal LCTL sent from the local dimming processing unit 10. Note that a drive control circuit is realized by the light source control circuit 42.

The illumination unit 44 includes the LED unit 50 and the area driver circuit as described above, and the operation of the area drive circuit is controlled by the light source control circuit 42, so that the LED 51 in the LED unit 50 emits light at a desired luminance. In this manner, the illumination unit 44 illuminates the display portion 32 with light from the back surface thereof.

As described above, in a state in which the voltage corresponding to the target display image is written to the pixel capacitor in each of the pixel portions 34 provided in the display portion 32 of the liquid crystal panel 30, the illumination unit 44 in the backlight 40 illuminates the display portion 32 with light from the back surface thereof. As a result, the desired image is displayed on the display portion 32.

1.2 Backlight

1.2.1 Schematic Configuration

Figure 13:
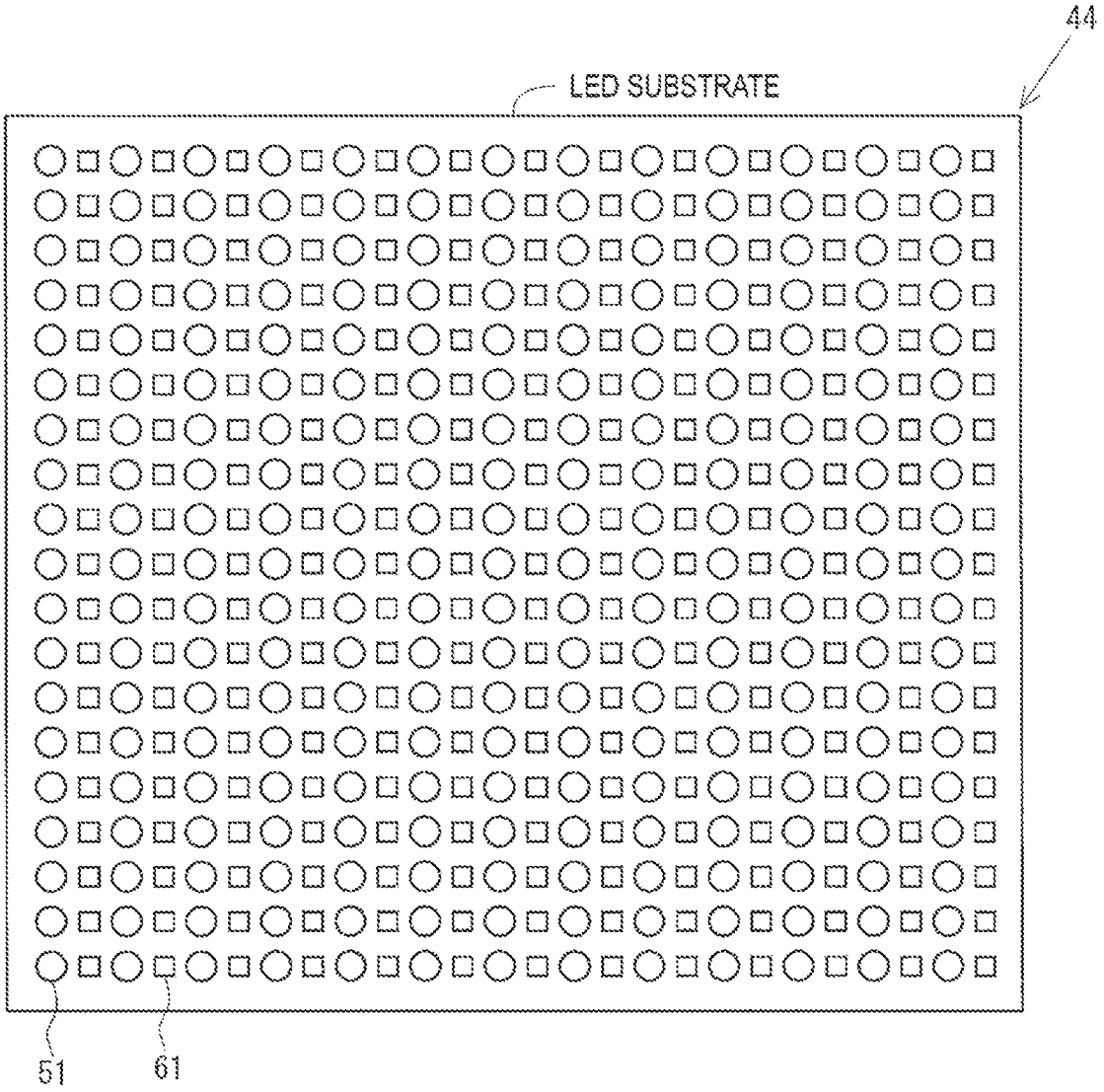
FIG. 13 is a schematic plan view of an illumination unit in the first embodiment.

FIG. 13 is a schematic plan view of the illumination unit 44. As illustrated in FIG. 13, a large number of the LEDs 51 and a large number of the drive transistors 61 are provided in a matrix shape on the LED substrate. In this configuration, the LED 51 and the drive transistor 61 are provided for each area. Each drive transistor 61 controls the current flowing in the corresponding LED 51.

Figure 14:
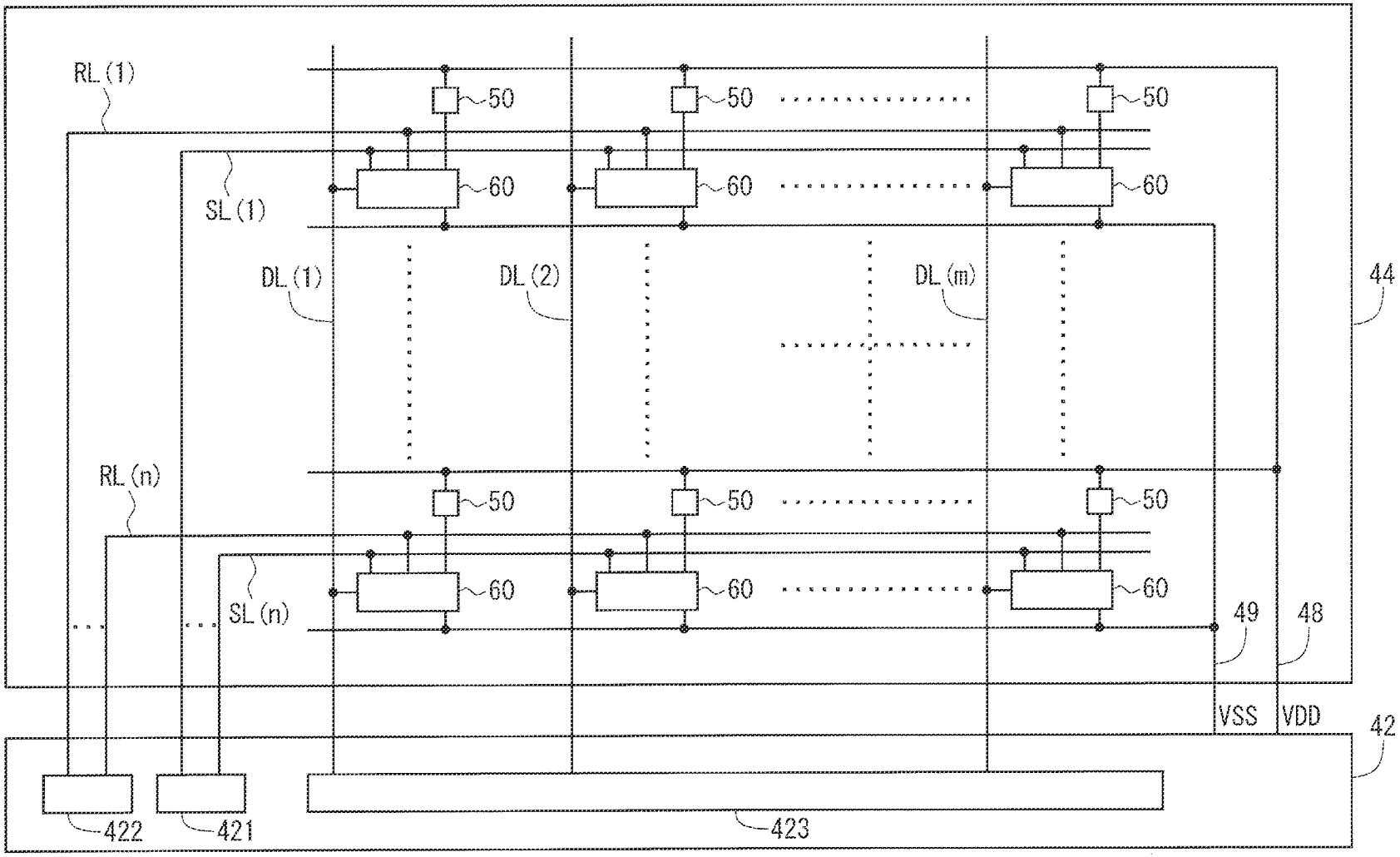
FIG. 14 is a block diagram for describing a schematic configuration of the backlight in the first embodiment.

FIG. 14 is a block diagram for describing a schematic configuration of the backlight 40. As described above, the backlight 40 includes the light source control circuit 42 and the illumination unit 44. In the present embodiment, the LED substrate forming the illumination unit 44 is logically divided into (n×m) areas. Specifically, it is assumed that the number of areas is not less than 1000 (1152 (24×48), for example). Note that the LED substrate is realized by, for example, a PCB.

The illumination unit 44 is provided with the LED unit 50, and the area drive circuit 60 that drives the LED 51 (one LED 51 in the present embodiment) included in the LED unit 50. The number of each of the LED unit 50 and the area drive circuit 60 provided is (n×m) (and thus is the same as the number of areas). Additionally, a VDD wiring line 48, a VSS wiring line 49, first write control lines SL provided for respective rows, second write control lines RL provided for respective rows, and data lines DL provided for respective columns are disposed on the LED substrate. The VDD wiring line 48 supplies high level power supply voltage VDD, the VSS wiring line 49 supplies low level power supply voltage VSS, first write control lines SL(1) to SL(n) carry a first write control signal output from the light source control circuit 42, second write control lines RL(1) to RL(n) carry a second write control signal output from the light source control circuit 42, and data lines DL(1) to DL(m) carry a data voltage output from the light source control circuit 42. Hereinafter, the first write control signal is denoted by the same reference sign SL as the first write control line, the second write control signal is denoted by the same reference sign RL as the second write control line, and the data voltage is denoted by the same reference sign DL as the data line.

The light source control circuit 42 includes a first shift register 421 that drives the first write control lines SL(1) to SL(n), a second shift register 422 that drives the second write control lines RL(1) to RL(n), and a data line drive circuit 423 that drives the data lines DL(1) to DL(m). The first shift register 421, the second shift register 422, and the data line drive circuit 423 control the operation of the (n×m) area drive circuits 60 so that the LEDs 51 included in the (n×m) LED units 50 are driven on a row-by-row basis.

Note that in the present embodiment, a first power supply voltage is realized by the high level power supply voltage VDD, a second power supply voltage is realized by the low level power supply voltage VSS, a first power supply line is realized by the VDD wiring line 48, and a second power supply line is realized by the VSS wiring line 49.

1.2.2 Configuration of Area Drive Circuit

Figure 1:
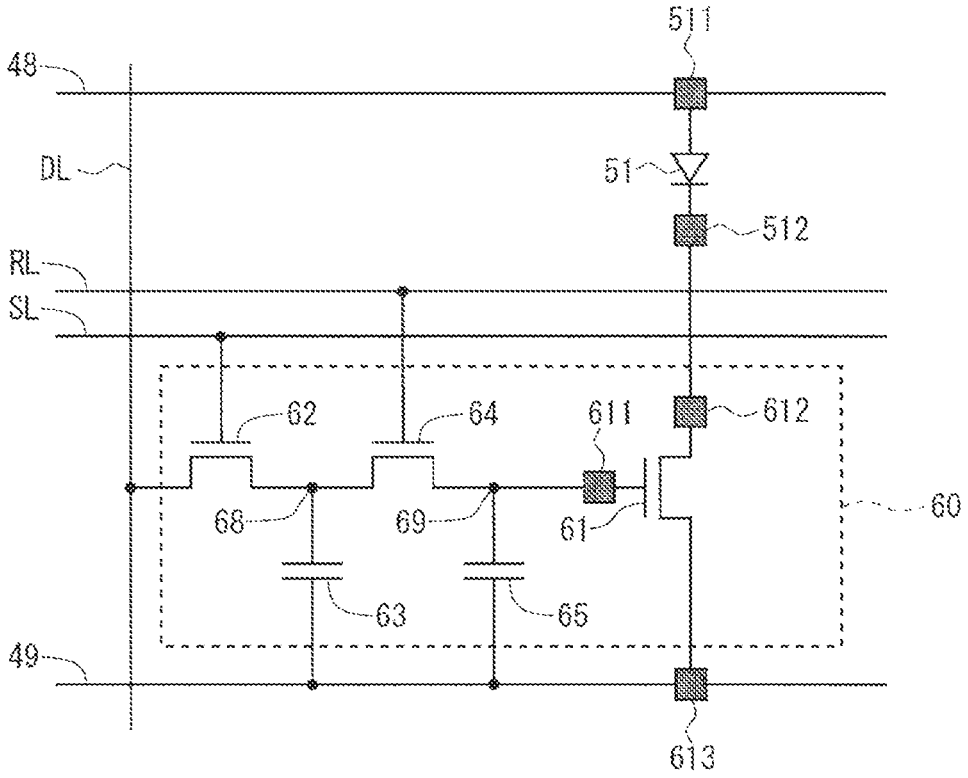
FIG. 1 is a circuit diagram illustrating a configuration of an area drive circuit in a first embodiment.

FIG. 1 is a circuit diagram illustrating a configuration of the area drive circuit 60. As illustrated in FIG. 1, the area drive circuit 60 includes the drive transistor 61, which is a MOSFET connected in series to the LED 51 to be driven, two TFTs 62 and 64, and two capacitors 63 and 65. In the present embodiment, both the MOSFET and the TFTs are of an n-channel type. Hereinafter, a TFT denoted by reference sign 62 is referred to as a "first write control transistor", a TFT denoted by reference sign 64 is referred to as a "second write control transistor", a capacitor denoted by reference sign 63 is referred to as a "first holding capacitor", and a capacitor denoted by reference sign 65 is referred to as a "second holding capacitor". Incidentally, for an n-channel type transistor, one terminal having a higher potential out of the drain and the source is generally referred to as the drain, but in the following description, one of the terminals is defined as a drain and the other is defined as a source, and thus, a source potential may be higher than a drain potential in some cases.

As illustrated in FIG. 1, the LED 51 and the drive transistor 61 are connected in series between the VDD wiring line 48 and the VSS wiring line 49. The drive transistor 61 has the gate terminal connected to the drain terminal of the second write control transistor 64 and one end of the second holding capacitor 65, has the drain terminal connected to the cathode terminal of the LED 51, and has the source terminal connected to the VSS wiring line 49. The first write control transistor 62 has the gate terminal connected to the first write control line SL, has the source terminal connected to the data line DL, and has the drain terminal connected to one end of the first holding capacitor 63 and the source terminal of the second write control transistor 64. The first holding capacitor 63 has one end connected to the drain terminal of the first write control transistor 62 and the source terminal of the second write control transistor 64, and has the other end connected to the VSS wiring line 49. The second write control transistor 64 has the gate terminal connected to the second write control line RL, has the source terminal connected to the drain terminal of the first write control transistor 62 and one end of the first holding capacitor 63, and has the drain terminal connected to one end of the second holding capacitor 65 and the gate terminal of the drive transistor 61. The second holding capacitor 65 has one end connected to the drain terminal of the second write control transistor 64 and the gate terminal of the drive transistor 61, and has the other end connected to the VSS wiring line 49. With reference to FIG. 1, a connection point (node) between one end of the first holding capacitor 63, the drain terminal of the first write control transistor 62, and the source terminal of the second write control transistor 64 is denoted by reference sign 68. A connection point (node) between one end of the second holding capacitor 65, the drain terminal of the second write control transistor 64, and the gate terminal of the drive transistor 61 is denoted by reference sign 69. A gate terminal corresponds to a control terminal, a source terminal corresponds to a first conduction terminal, and a drain terminal corresponds to a second conduction terminal.

Of the components illustrated in FIG. 1, the LED 51 and the drive transistor 61 are provided on the LED substrate as external components. Specifically, an anode terminal and a cathode terminal of the LED 51 are respectively connected to pads 511 and 512 formed on the LED substrate. A gate terminal, a drain terminal, and a source terminal of the drive transistor 61 are respectively connected to pads 611, 612, and 613 formed on the LED substrate.

In the present embodiment, Cs represents the sum of Cs1 and Cs2, and Cs1 is approximately 10 times as large as Cs2, where Cs is the electrostatic capacitance value of the holding capacitor 93 in the configuration illustrated in FIG. 2, Cs1 is the electrostatic capacitance value of the first holding capacitor 63, and Cs2 is the electrostatic capacitance value of the second holding capacitor 65. However, the configuration is not limited thereto.

1.2.3 Driving Method

Next, a driving method in the present embodiment will be described, focusing on a case in which the target luminance changes from a minimum luminance (0 cd/m$^2$) to a maximum luminance. Note that the data voltage corresponding to the minimum luminance and the low level power supply voltage VSS are assumed to be 0 V.

Figure 15:
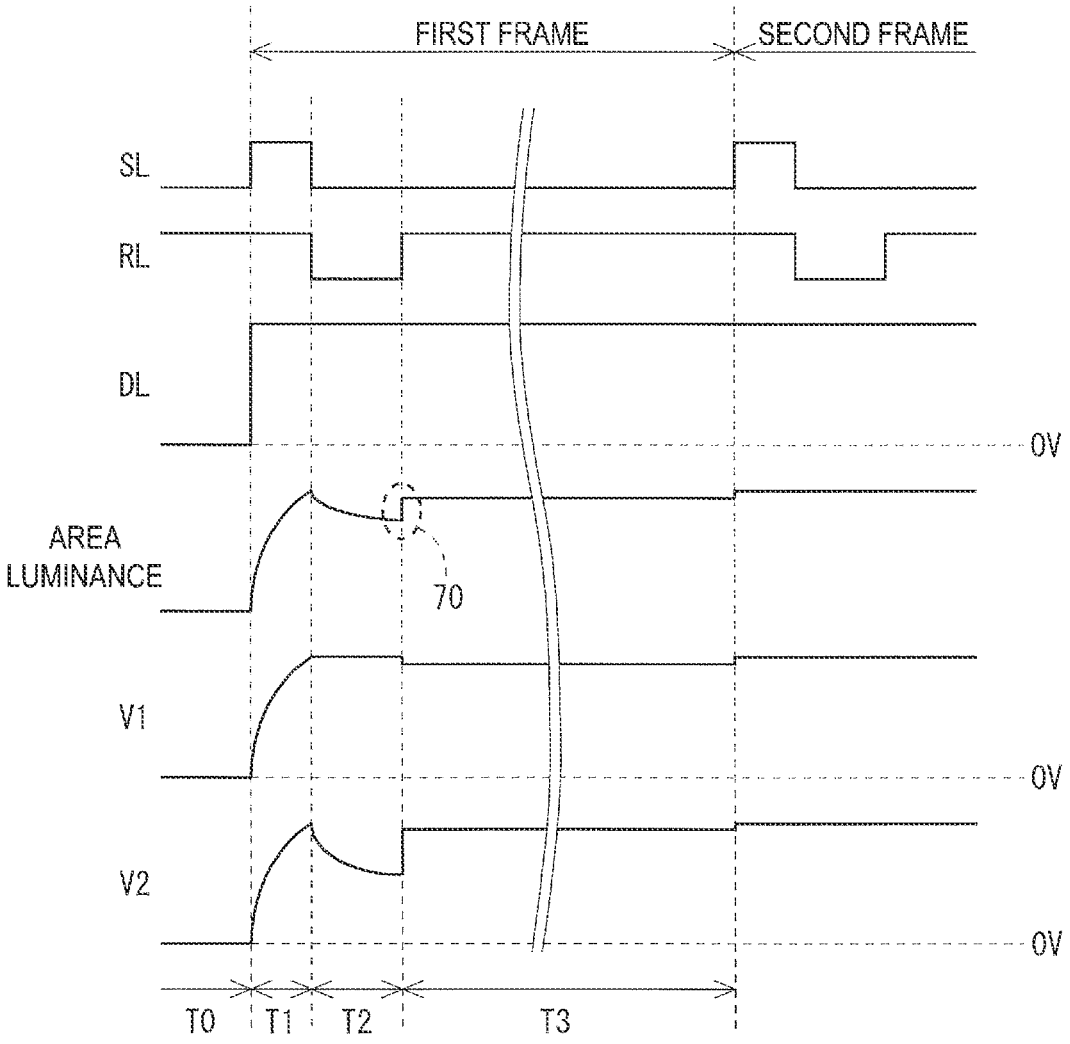
FIG. 15 is a waveform diagram for describing a driving method in the first embodiment.

FIG. 15 illustrates changes in the first write control signal SL, the second write control signal RL, the data voltage DL, the area luminance, a potential V1 of a node 68 (one end of the first holding capacitor 63), and a potential V2 of a node 69 (one end of the second holding capacitor 65). Note that here, the focus is placed on a certain single area and a corresponding area drive circuit 60.

In a time period T0, the first write control signal SL is at the low level, and the second write control signal RL is at the high level. Accordingly, the first write control transistor 62 is in the off state, and the second write control transistor 64 is in the on state. In this case, in the frame period immediately before the first frame, the writing of the data voltage DL corresponding to the minimum luminance is performed (writing to the first holding capacitor 63 and the second holding capacitor 65). Thus, in the time period T0, the potential V1 of the node 68 and the potential V2 of the node 69 are 0 V, and the area luminance is the minimum luminance. The data voltage DL is 0 V in the time period T0. Note that since the data voltage DL changes every time writing to each row is performed as illustrated in FIG. 4, the data voltage DL is not necessarily 0 V at the end point of the time period T0 even in a case in which the target luminance of the area of interest changes from the minimum luminance to the maximum luminance.

When a time period T1 is reached, the first write control signal SL changes from the low level to the high level, and the second write control signal RL is maintained at the high level. As a result, the first write control transistor 62 changes from the off state to the on state, and the second write control transistor 64 is maintained in the on state. Then, the first write control signal SL and the second write control signal RL are maintained at the high level throughout the time period T1. In other words, the first write control transistor 62 and the second write control transistor 64 are both maintained in the on state in the time period T1. In addition, when the time period T1 is reached, the data voltage DL changes from 0 V to a voltage corresponding to the maximum luminance. As described above, the voltage corresponding to the maximum luminance is written to the first holding capacitor 63 and the second holding capacitor 65. As a result, as illustrated in FIG. 15, the potential V1 of the node 68 and the potential V2 of the node 69 are greatly increased in the time period T1. Then, a voltage corresponding to the maximum luminance is applied to the gate of the drive transistor 61, and the area luminance greatly increases. Note that FIG. 15 also represents a delay in the waveform with respect to the area luminance, the potential V1 of the node 68, and the potential V2 of the node 69.

When a time period T2 is reached, both the first write control signal SL and the second write control signal RL change from the high level to the low level. As a result, the first write control transistor 62 and the second write control transistor 64 both change from the on state to the off state. Then, the first write control signal SL and the second write control signal RL are maintained at the low level throughout the time period T2. In other words, the first write control transistor 62 and the second write control transistor 64 are both maintained in the off state in the time period T2. The state in the inversion layer in the drive transistor 61 does not reach the activation state up to the end point of the time period T1, and the number of carriers in the inversion layer decreases in the time period T2 due to an increase in the carrier disappearance ratio as described above. As a result, the potential V2 of the node 69 decreases, and the current flowing between the drain and the source of the drive transistor 61 decreases, leading to a reduction in the area luminance.

Note that in the present embodiment, the time period T2 is set to a length equal to or greater than the length of the carrier activation time described above. In other words, the length of the time period T2 is equal to or longer than the time required for the inversion layer to be formed in the drive transistor 61 when the gate voltage of the drive transistor 61 is changed from a voltage corresponding to the minimum luminance to a voltage corresponding to the maximum luminance, and the carrier density to become constant in the inversion layer.

Thereafter, when a time period T3 is reached, the second write control signal RL changes from the low level to the high level. As a result, the second write control transistor 64 changes from the off state to the on state. Note that since the first write control signal SL is maintained at the low level, the first write control transistor 62 is maintained in the off state. As described above, the node 68 and the node 69 are electrically connected in the time period T3. Therefore, the potential V1 of the node 68 and the potential V2 of the node 69 become equal. In this regard, as described above, since the electrostatic capacitance value Cs1 of the first holding capacitor 63 is approximately 10 times as large as the electrostatic capacitance value Cs2 of the second holding capacitor 65, the potential V1 of the node 68 slightly decreases, while the potential V2 of the node 69 greatly increases. In other words, the gate voltage of the drive transistor 61 greatly increases. As a result, the area luminance increases as illustrated in the portion denoted by reference sign 70 in FIG. 15. As a result, luminance reduction in the first frame when the area luminance is increased from 0 cd/m$^2$ is suppressed.

Note that the luminance reduction does not occur in the second frame and thereafter, but even if the area drive circuit 60 is operated in the second frame and thereafter in the same manner as in the first frame, no particular problem occurs. Therefore, it is not necessary to vary the waveforms of the first write control signal SL and the second write control signal RL provided to the area drive circuit 60 between the first frame and the second frame and thereafter, and the configuration of the area drive circuit 60 need not be made in such a special configuration that operates differently between the first frame and the second frame and thereafter.

With respect to the above-described operation, the higher the ratio of the electrostatic capacitance value Cs1 of the first holding capacitor 63 to the total value of the electrostatic capacitance value Cs1 of the first holding capacitor 63 and the electrostatic capacitance value Cs2 of the second holding capacitor 65 is, the greater the potential V2 of the node 69 increases during the transition from the time period T2 to the time period T3. Therefore, the electrostatic capacitance value Cs2 of the second holding capacitor 65 is preferably 1/10 of the electrostatic capacitance value Cs1 of the first holding capacitor 63 or smaller.

Incidentally, since parasitic capacitance exists between the gate and the drain of the second write control transistor 64, the potential V2 of the node 69 is actually influenced by changes in the potential of the second write control line RL. In other words, the area luminance is influenced by changes in the potential of the second write control line RL. Thus, changes in the area luminance in consideration of this influence will be described with reference to FIG. 16. Note that the potential V1 of the node 68 is influenced by changes in the potential of the first write control line SL and changes in the potential of the second write control line RL due to the parasitic capacitance between the gate and the drain of the first write control transistor 62 and parasitic capacitance between the gate and the source of the second write control transistor 64. However, electrostatic capacitance values of these parasitic capacitances are sufficiently smaller than the electrostatic capacitance value Cs1 of the first holding capacitor 63, and thus the influence of changes in the potential of the first write control line SL and changes in the potential of the second write control line RL on the potential V1 of the node 68 can be presumably ignored.

A pull-in voltage ΔVa due to a change (decrease) in the potential of the second write control line RL is expressed by Equation (1) below where Cgd is the electrostatic capacitance value of the parasitic capacitance between the gate and the drain of the second write control transistor 64, Cother is the total value of the electrostatic capacitance values of the parasitic capacitance other than the parasitic capacitance between the gate and the drain of the second write control transistor 64, and ΔV(RL) is the difference between the high level potential and the low level potential of the second write control signal RL. The same applies to a thrust voltage ΔVb due to a change (increase) in the potential of the second write control line RL.

$$\Delta Va=(Cgd/(Cs2+Cgd+\text{Cother}))\times\Delta V(RL) \quad (1)$$

During the transition from the time period T1 to the time period T2, the pull-in voltage ΔVa is generated on the potential V2 of the node 69 (the gate voltage of the drive transistor 61) due to a change in the second write control signal RL from the high level to the low level. Therefore, as indicated by the arrow denoted by reference sign 71 in FIG. 16, a reduction in the area luminance occurs due to the pull-in voltage ΔVa.

During the time period T2, as described above, the number of carriers in the inversion layer decreases in the drive transistor 61. As a result, the current flowing between the drain and the source of the drive transistor 61 decreases, whereby the area luminance reduces.

During the transition from the time period T2 to the time period T3, the thrust voltage ΔVb is generated on the potential V2 of the node 69 (the gate voltage of the drive transistor 61) due to a change in the second write control signal RL from the low level to the high level. Therefore, as indicated by the arrow denoted by reference sign 72 in FIG. 16, an increase in the area luminance occurs due to the thrust voltage ΔVb. Note that the arrow denoted by reference sign 73 in FIG. 16 represents an increase in the area luminance due to the node 68 and the node 69 being electrically connected.

As described above, the reduction in the area luminance due to the pull-in voltage ΔVa and the increase in the area luminance due to the thrust voltage ΔVb are cancelled out, and the area luminance becomes a luminance near the target luminance in the time period T3.

Figure 16:
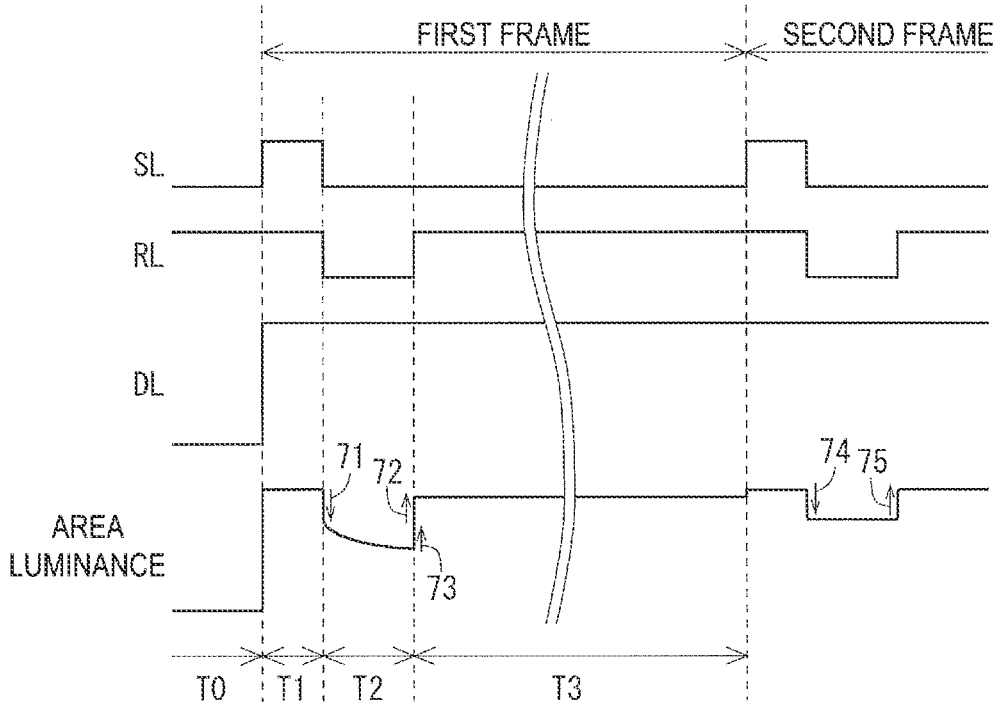
FIG. 16 is a waveform diagram for describing the driving method in the first embodiment.

In the second frame and thereafter, while a reduction in the area luminance as indicated by the arrow denoted by reference sign 74 in FIG. 16 and an increase in the area luminance as indicated by the arrow denoted by reference sign 75 in FIG. 16 occur, the reduction in the area luminance and the increase in the area luminance are cancelled out, and thus no particular problem will occur.

Note that in the present embodiment, a first write period is realized by the time period T1, a first write stop period is realized by the time period T2, and a second write period is realized by the time period T3.

1.3 Effects

According to the present embodiment, two holding capacitors (the first holding capacitor 63 and the second holding capacitor 65) are provided to each area drive circuit 60. The second holding capacitor 65 has one end connected to the gate terminal of the drive transistor 61. The first holding capacitor 63 has one end connected to one end of the second holding capacitor 65 via the second write control transistor 64. The electrostatic capacitance value Cs1 of the first holding capacitor 63 is approximately 10 times as large as the electrostatic capacitance value Cs2 of the second holding capacitor 65. With the configuration described above, the following operations are performed in each frame period. First of all, the data voltage DL is written to the two holding capacitors. Next, the second write control transistor 64 is maintained in the off state during a period with a length that is equal to or longer than the length of the carrier activation time described above. Then, the second write control transistor 64 is set to be in the on state. With the operation above, in each area drive circuit 60, pseudo rewriting of the data voltage DL is performed after the period with a length that is equal to or longer than the length of the carrier activation time described above has elapsed, after the data voltage DL has been written. Thus, even when the area luminance temporarily reduces after the data voltage DL has been written in a case in which the target luminance sharply increases, the area luminance increases due to the pseudo rewriting of the data voltage DL. The time period T2 between the first writing of the data voltage DL and the pseudo rewriting of the data voltage DL is set to be of a length that is equal to or longer than the length of the carrier activation time described above. Thus, the area luminance does not reduce after the pseudo rewriting of the data voltage DL.

Figure 17:
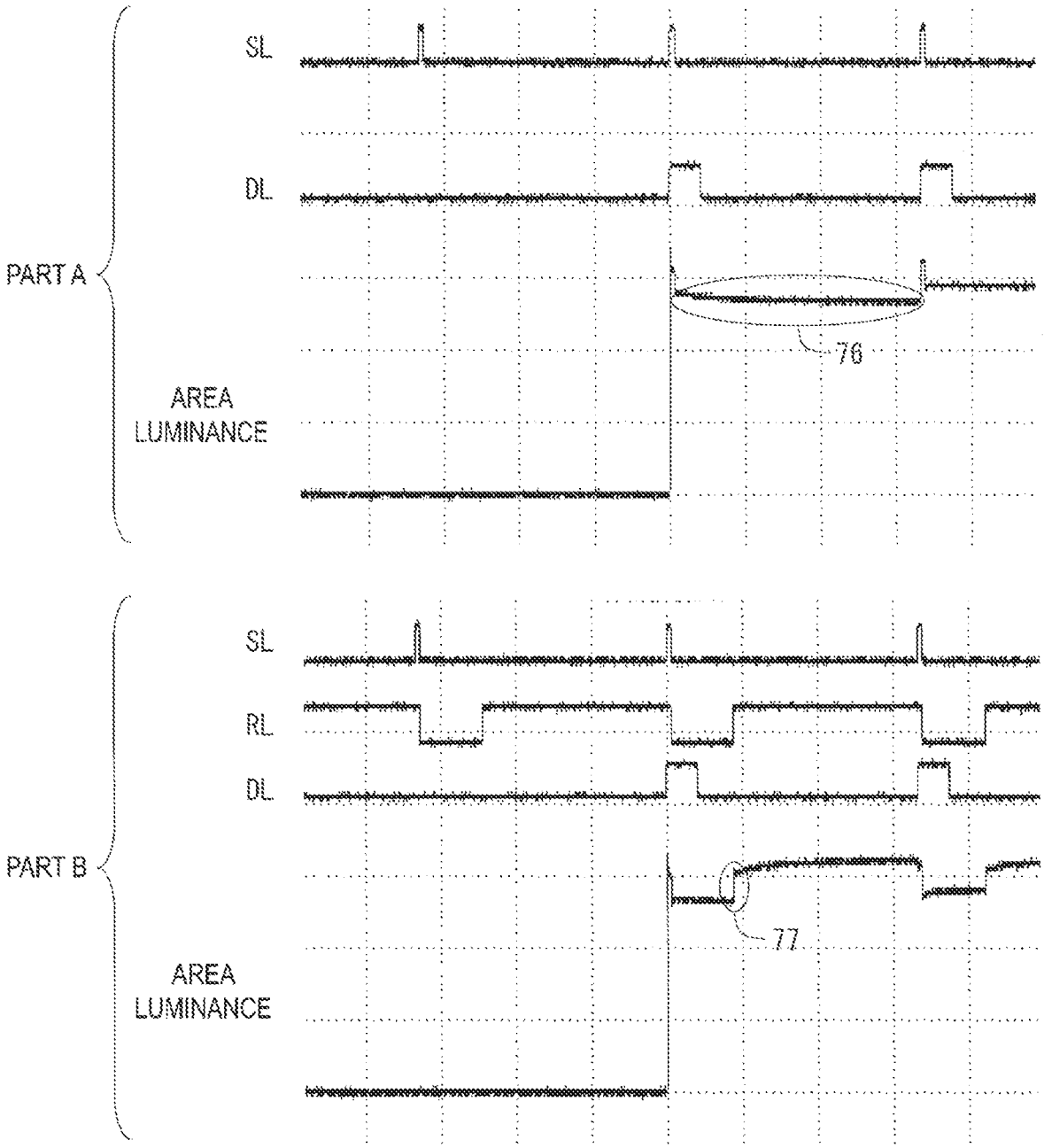
FIG. 17 is a waveform diagram for describing an effect of the first embodiment.

Part A of FIG. 17 illustrates a waveform diagram of a result of performing an experiment using the area drive circuit 90 having the configuration illustrated in FIG. 2. Part B of FIG. 17 illustrates a waveform diagram of a result of performing an experiment using the area drive circuit 60 of the present embodiment. In the case in which the area drive circuit 90 having the configuration illustrated in FIG. 2 is used, a luminance reduction occurs in the first frame, as illustrated in a portion denoted by reference sign 76 in FIG. 17. On the other hand, in the case in which the area drive circuit 60 of the present embodiment is used, the reduced area luminance is increased by the pseudo rewriting of the data voltage DL, as illustrated in a portion indicated by reference sign 77 in FIG. 17.

According to the present embodiment as described above, the backlight 40 is realized that can suppress the occurrence of a luminance reduction in the frame period immediately after a sharp increase in the target luminance.

2. Second Embodiment

2.1 for Case in which Electrostatic Capacitance Value of Second Holding Capacitor is Significantly Small As described above, since parasitic capacitance exists between the gate and the drain of the second write control transistor 64, the pull-in voltage ΔVa and the thrust voltage ΔVb are generated on the gate voltage of the drive transistor 61 due to changes in the potential of the second write control line RL. In this regard, with reference to FIG. 16, a case is described in which the reduction in the area luminance due to the pull-in voltage ΔVa and the increase in the area luminance due to the thrust voltage ΔVb are cancelled out. However, if the electrostatic capacitance value Cs2 of the second holding capacitor 65 is significantly small, the reduction in the area luminance due to the pull-in voltage ΔVa and the increase in the area luminance due to the thrust voltage ΔVb are not cancelled out in some cases. This may cause the LED 51 to turn on at a low luminance (i.e., display failure occurs) even when the LED 51 should be maintained in the turn-off state. This is described below.

In recent years, as the pixel area has become smaller, the capacitor for holding voltage needs to be formed in a region of limited area. Since the electrostatic capacitance value of the capacitor is proportional to the area of the capacitor (area of the electrodes), if the pixel area is small, a holding capacitor with a desired electrostatic capacitance value may not be formed on an LED substrate. In such a case, holding capacitors (first holding capacitor 63 and second holding capacitor 65) having electrostatic capacitance values that are equal to or less than the desired electrostatic capacitance value are formed in the area drive circuit 60.

From Equation (1) above, it is understood that the smaller the electrostatic capacitance value Cs2 of the second holding capacitor 65 is, the larger the pull-in voltage ΔVa and the thrust voltage ΔVb are. Hereinafter, the pull-in voltage ΔVa and the thrust voltage ΔVb are collectively represented by ΔV.

Figure 18:
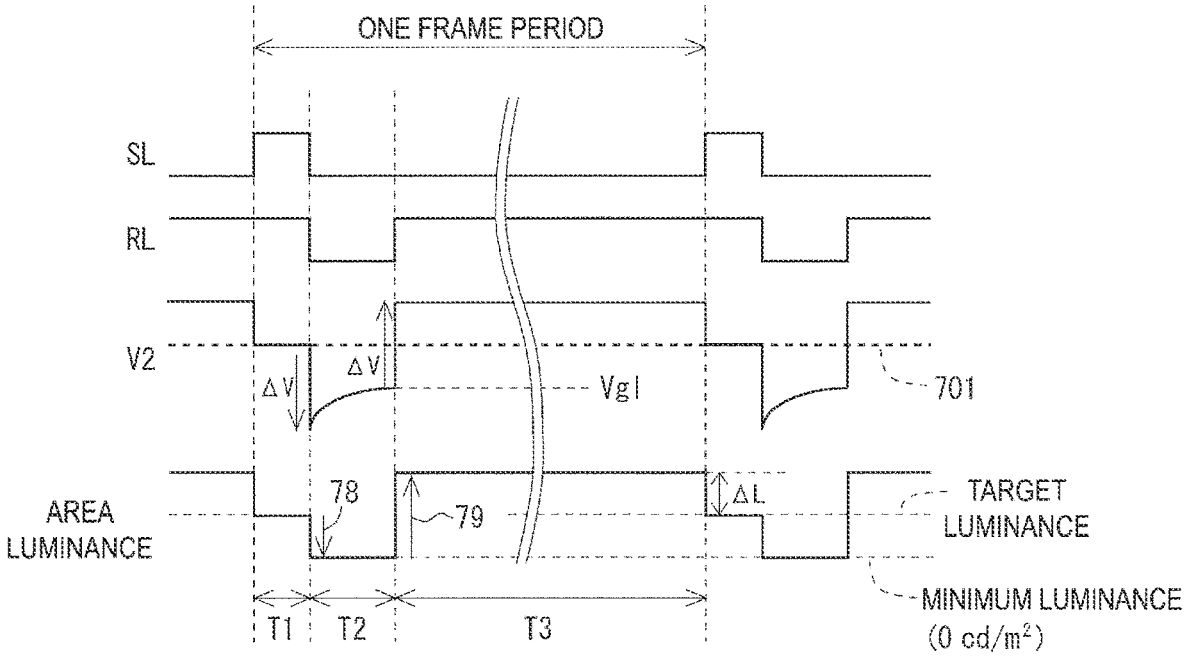
FIG. 18 is a waveform diagram for explaining that display failure can occur when an electrostatic capacitance value of a second holding capacitor is significantly small.

FIG. 18 illustrates an example of changes in the first write control signal SL, the second write control signal RL, the potential V2 of the node 69 (one end of the second holding capacitor 65), and the area luminance when the driving method according to the first embodiment described above is employed in a case in which the electrostatic capacitance value Cs2 of the second holding capacitor 65 is significantly small and the target luminance is significantly small. The data voltage is maintained at the level of the dashed line denoted by reference sign 701 in FIG. 18. When the data voltage at this time is represented by Vi, Vi is a low voltage that satisfies Relationship (2) below.

$$VSS \leq Vi < Vgl + \Delta V \quad (2)$$

In Relationship (2) above, Vgl is the low level potential of the first write control signal SL and the second write control signal RL, and is lower than VSS.

In FIG. 18, the focus is placed on changes in the potential V2 of the node 69. In a time period T1, since the first write control transistor 62 and the second write control transistor 64 are both in the on state with the low voltage Vi applied to the data line DL, the potential V2 of the node 69 becomes equal to the low voltage Vi described above.

When a time period T2 is reached, both the first write control signal SL and the second write control signal RL change from the high level to the low level. This results in a pull-in voltage. That is, during transition from the time period T1 to the time period T2, the potential V2 of the node 69 decreases by ΔV. Thus, the potential V2 of the node 69 becomes "Vi−ΔV" immediately after the start point of the time period T2. Furthermore, Relationship (3) below is derived from Relationship (2) above.

$$Vi - \Delta V < Vgl \quad (3)$$

As described above, the potential V2 of the node 69 is lower than the gate voltage of the second write control transistor 64 immediately after the start point of the time period T2. Thus, the second write control transistor 64 is not in a fully off state, and a leakage current is generated between the source and the drain of the second write control transistor 64. As a result, the potential V2 of the node 69 gradually increases to Vgl described above in the time period T2.

Thereafter, when a time period T3 is reached, the second write control signal RL changes from the low level to the high level. This results in a thrust voltage. That is, during transition from the time period T2 to the time period T3, the potential V2 increases by ΔV. Thus, the potential V2 of the node 69 becomes "Vgl+ΔV" immediately after the start point of the time period T3. From Relationship (3) above, it is understood that this "Vgl+ΔV" is larger than the low voltage Vi described above. Thus, in the time period T3, the potential V2 of the node 69 is higher than a desired potential. The state in which the potential V2 of the node 69 is higher than the desired potential is maintained until the point when the first write control signal SL next changes from the low level to the high level (i.e., the start point of the next frame period).

Now, the focus is placed on changes in the area luminance. During transition from the time period T1 to the time period T2, the area luminance reduces as indicated by the arrow denoted by reference sign 78 in FIG. 18 with a decrease in the potential V2 of the node 69. The area luminance after the decrease is the minimum luminance (0 cd/m$^2$). During transition from the time period T2 to the time period T3, the area luminance increases as indicated by the arrow denoted by reference sign 79 in FIG. 18 with an increase in the potential V2 of the node 69. From FIG. 18, it is understood that the degree of the increase in the area luminance during transition from the time period T2 to the time period T3 is larger than the degree of the reduction in the area luminance during transition from the time period T1 to the time period T2. That is, the reduction in the area luminance due to the pull-in voltage ΔVa and the increase in the area luminance due to the thrust voltage ΔVb are not cancelled out. As a result, the area luminance is higher than the target luminance by ΔL in the time period T3.

As described above, the LED 51 may turn on at a low luminance during the period where the area luminance should be maintained at the minimum luminance (0 cd/m$^2$). To address this, in the present embodiment described above, a driving method different from that of the first embodiment is employed.

Figure 19:
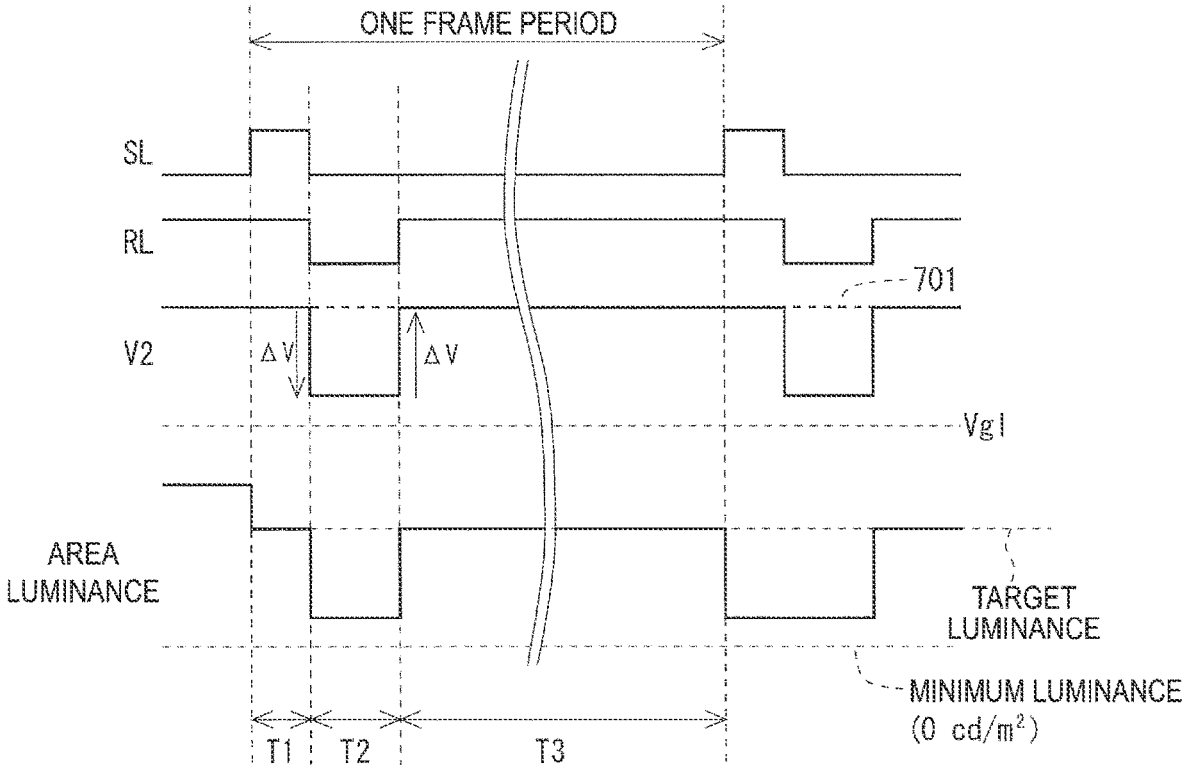
FIG. 19 is a waveform diagram for explaining that display failure does not occur even when the electrostatic capacitance value of the second holding capacitor is significantly small if a target luminance is high to a certain degree.

Note that in a case in which the target luminance is high to a certain degree (a case in which Vi described above is greater than "Vgl+ΔV"), the potential V2 of the node 69 is maintained at a level higher than Vgl described above (the gate voltage of the second write control transistor 64) in the time period T2 as illustrated in FIG. 19. Accordingly, a reduction in the area luminance due to a current leakage at the second write control transistor 64 does not occur throughout the time period T2. Thus, the potential V2 of the node 69 immediately after the start point of the time period T3 is equal to the potential V2 of the node 69 immediately before the end point of the time period T1. As described above, when the target luminance is high to a certain degree, the reduction in the area luminance due to the pull-in voltage ΔVa and the increase in the area luminance due to the thrust voltage ΔVb are cancelled out.

2.2 Configuration

The configuration of the liquid crystal display device and the configuration of the backlight 40 are similar to those in the first embodiment described above, and thus the description thereof will be omitted (see FIG. 1 and FIG. 7 to FIG. 14). Here, it is assumed that the electrostatic capacitance value Cs2 of the second holding capacitor 65 is significantly small.

2.3 Driving Method

Figure 20:
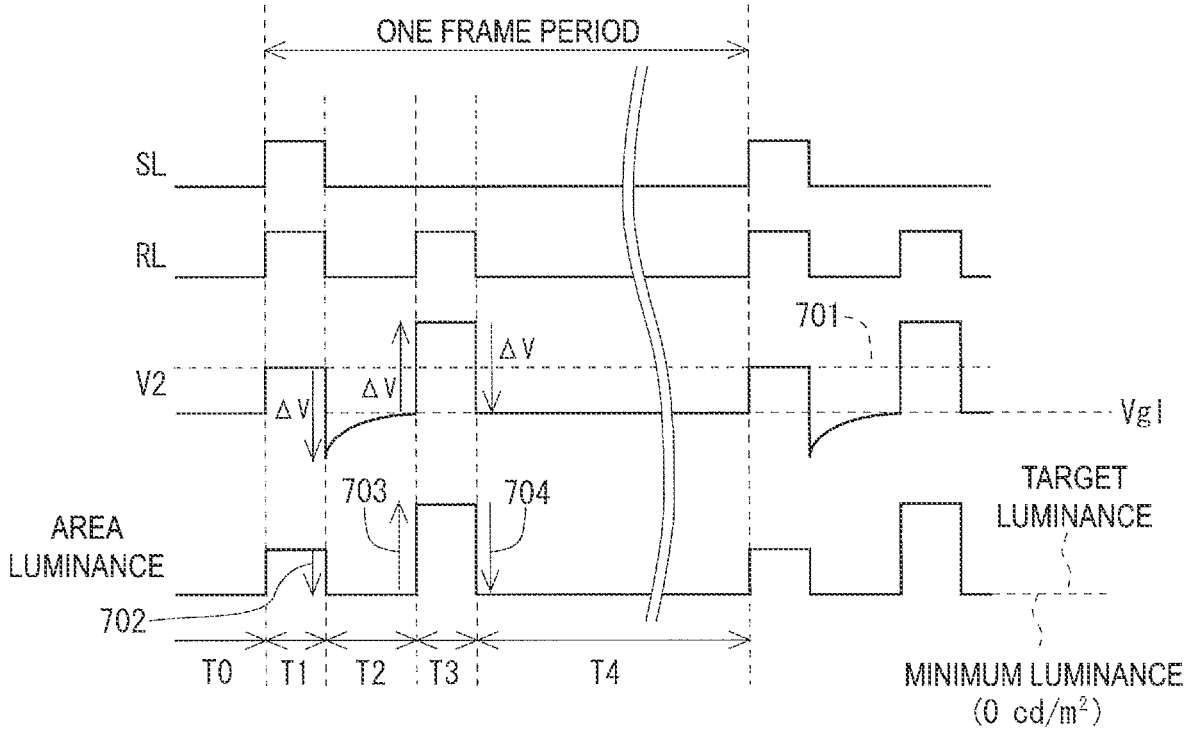
FIG. 20 is a waveform diagram for describing a driving method in a second embodiment.

Next, a driving method in the present embodiment will be described, focusing on a case in which the target luminance is maintained at the minimum luminance (0 cd/m$^2$). FIG. 20 illustrates changes in the first write control signal SL, the second write control signal RL, the potential V2 of the node 69, and the area luminance. The data voltage is maintained at the level of the dashed line denoted by reference sign 701 in FIG. 20. The low voltage Vi satisfying Relationship (2) above serves as this data voltage.

In a time period T0, the first write control signal SL and the second write control signal RL are both at the low level. Accordingly, the first write control transistor 62 and the second write control transistor 64 are both in the off state. The potential V2 of the node 69 becomes equal to Vgl described above, and the area luminance becomes the minimum luminance.

When the time period T1 is reached, both the first write control signal SL and the second write control signal RL change from the low level to the high level. As a result, the first write control transistor 62 and the second write control transistor 64 both change from the off state to the on state. As a result, the data voltage is written to the first holding capacitor 63 and the second holding capacitor 65, whereby the potential V2 of the node 69 becomes equal to the low voltage Vi described above, and the area luminance slightly increases.

When a time period T2 is reached, both the first write control signal SL and the second write control signal RL change from the high level to the low level. As a result, the first write control transistor 62 and the second write control transistor 64 both change from the on state to the off state. At this time, a pull-in voltage is generated. That is, during transition from the time period T1 to the time period T2, the potential V2 of the node 69 decreases by ΔV. Accordingly, the area luminance reduces as indicated by the arrow denoted by reference sign 702 in FIG. 20. Due to the pull-in voltage, the potential V2 of the node 69 becomes "Vi−ΔV" immediately after the start point of the time period T2. In this regard, as expressed in Relationship (3) above, "Vi−ΔV" is smaller than Vgl described above. In other words, the potential V2 of the node 69 is lower than the gate voltage of the second write control transistor 64 immediately after the start point of the time period T2. Thus, a leakage current is generated between the source and the drain of the second write control transistor 64. As a result, the potential V2 of the node 69 gradually increases to Vgl described above in the time period T2. Note that in the present embodiment as well, the time period T2 is set to a length equal to or more than the length of the carrier activation time described above.

When a time period T3 is reached, the second write control signal RL changes from the low level to the high level. As a result, the second write control transistor 64 changes from the off state to the on state. At this time, a thrust voltage is generated. That is, during transition from the time period T2 to the time period T3, the potential V2 of the node 69 increases by ΔV. Thus, the potential V2 of the node 69 becomes "Vgl+ΔV" immediately after the start point of the time period T3. In addition, during transition from the time period T2 to the time period T3, the area luminance increases as indicated by the arrow denoted by reference sign 703 in FIG. 20 with an increase in the potential V2 of the node 69.

In the above-described first embodiment, the state in which the first write control signal SL is at the low level and the second write control signal RL is at the high level is maintained until the point when the next writing of the data voltage is to be started in the corresponding area drive circuit 60. By contrast, in the present embodiment, the light source control circuit 42 performs control so as to maintain both the first write control signal SL and the second write control signal RL at the low level for most of the period during one frame period. For example, the state in which the first write control signal SL is at the low level and the second write control signal RL is at the high level is maintained for a period with a length that is equal to the length of the time period T1.

When a time period T4 is reached, the second write control signal RL changes from the high level to the low level. As a result, the second write control transistor 64 changes from the on state to the off state. At this time, a pull-in voltage is generated. That is, during transition from the time period T3 to the time period T4, the potential V2 decreases by ΔV. Thus, the potential V2 of the node 69 becomes equal to Vgl described above immediately after the start point of the time period T4. In addition, during transition from the time period T3 to the time period T4, the area luminance reduces as indicated by the arrow denoted by reference sign 704 in FIG. 20 with a decrease in the potential V2 of the node 69. In this way, the area luminance becomes equal to the minimum luminance (0 cd/m$^2$), which is the target luminance, in the time period T4.

As described above, even if the area luminance temporarily increases due to the thrust voltage during transition from the time period T2 to the time period T3, the area luminance reduces due to the pull-in voltage generated during transition from the time period T3 to the time period T4. As a result, an increase in the area luminance over the target luminance is suppressed.

Incidentally, in the driving method of the present embodiment, the LED 51 is not turned on while the data voltage is equal to or less than "Vgl+ΔV", and thus the luminance of the LED 51 is controlled in such a range that the data voltage is greater than "Vgl+ΔV" in cases where the LED 51 is to be turned on.

Note that in the present embodiment, a first write period is realized by the time period T1, a first write stop period is realized by the time period T2, a second write period is realized by the time period T3, and a second write stop period is realized by the time period T4.

2.4 Effects

According to the present embodiment, as in the first embodiment described above, the backlight 40 is realized that can suppress the occurrence of a luminance reduction in the frame period immediately after a sharp increase in the target luminance. According to the present embodiment, the second write control transistor 64 changes from the off state to the on state as a result of the pseudo rewriting of the data voltage DL, and then changes from the on state to the off state after a predetermined period elapses, so that the first write control transistor 62 and the second write control transistor 64 are both maintained in the off state for most of the period during one frame period. When the second write control transistor 64 changes from the on state to the off state, the area luminance reduces due to the generation of the pull-in voltage regarding the gate voltage of the drive transistor 61. With the above configuration, in a case in which the electrostatic capacitance value Cs2 of the second holding capacitor 65 is significantly small, even when the reduction in the area luminance due to the pull-in voltage ΔVa during transition from the time period T1 to the time period T2 and the increase in the area luminance due to the thrust voltage ΔVb during transition from the time period T2 to the time period T3 are not cancelled out (even when the degree of the increase in the area luminance is larger than the degree of the reduction in the area luminance), the area luminance reduces again due to the pull-in voltage ΔVa. As a result, an increase in the area luminance over the target luminance is suppressed. For example, the turning on of the LED 51 at a low luminance during the period where the area luminance should be maintained at the minimum luminance (0 cd/m$^2$) is suppressed.

Figure 21:
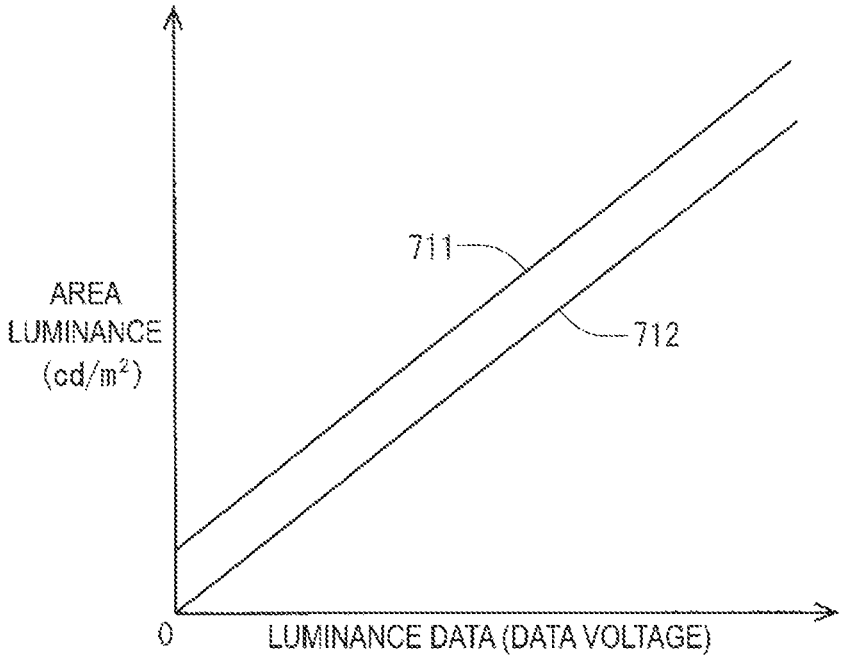
FIG. 21 is a diagram for describing a difference between the first embodiment and the second embodiment.

FIG. 21 is a diagram for describing a difference between the first embodiment described above and the present embodiment. FIG. 21 illustrates a difference in area luminance between the first embodiment described above and the present embodiment, in a case in which the range of data voltage is the same. The line denoted by reference sign 711 represents the relationship between the luminance data (data voltage) and the area luminance according to the first embodiment described above, and the line denoted by reference sign 712 represents the relationship between the luminance data (data voltage) and the area luminance according to the present embodiment. According to the present embodiment, the maximum luminance achieved is lower than that in the first embodiment described above. Still, according to the present embodiment, the minimum luminance of 0 cd/m$^2$ can be achieved. Thus, according to the present embodiment, the area luminance can be lower than that in the first embodiment described above (the area can be darker).

3. Third Embodiment

3.1 Overall Configuration

Figure 22:
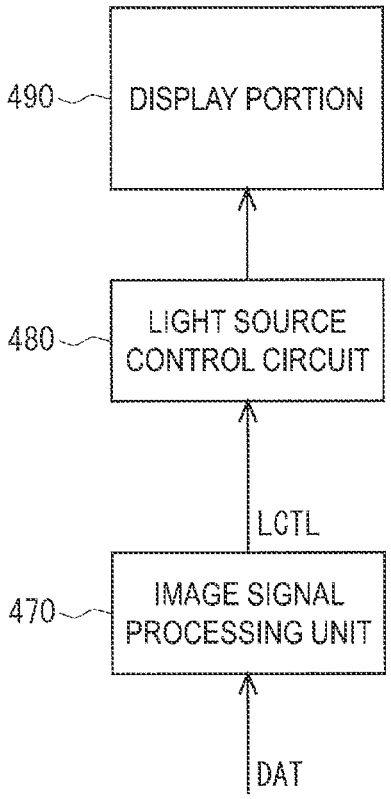
FIG. 22 is a block diagram illustrating an overall configuration of an LED display device according to a third embodiment.

FIG. 22 is a block diagram illustrating an overall configuration of an LED display device according to a third embodiment. The LED display device is a display device using an LED as a pixel. As illustrated in FIG. 22, the LED display device is configured by an image signal processing unit 470, a light source control circuit 480, and a display portion 490. Note that the display portion 490 according to the present embodiment corresponds to the illumination unit 44 (see FIG. 7) according to the first embodiment described above. In other words, the display portion 490 includes an LED unit and an area drive circuit provided on a substrate (LED substrate).

The image signal processing unit 470 receives the image data DAT transmitted from the outside and outputs the luminance control signal LCTL for controlling the operation of the light source control circuit 480. Note that the luminance control signal LCTL includes a plurality of control signals. The light source control circuit 480 controls the operation of the area drive circuit, so that the LED in the display portion 490 emits light at a desired luminance, based on the luminance control signal LCTL transmitted from the image signal processing unit 470. The display portion 490 includes the LED unit and the area driver circuit as described above, and the operation of the area drive circuit is controlled by the light source control circuit 480, so that LED in the LED unit emits light at a desired luminance.

In the present embodiment, the plurality of LED units provided on the display portion 490 are classified into three types. More specifically, the plurality of LED units are classified into a red LED unit including a red LED emitting red light, a green LED unit including a green LED emitting green light, and a blue LED unit including a blue LED emitting blue light. Further, the plurality of LED units described above are arranged such that one picture element includes the red LED unit, the green LED unit, and the blue LED unit. Accordingly, with the LEDs in the plurality of LED units described above emitting light at a desired luminance, an image is displayed on this display portion 490.

Note that, although an example in which one picture element includes LED units of three types of colors is described herein, a single picture element may include LED units of four or more types of colors.

3.2 Configurations of Display Portion and Light Source Control Circuit

Figure 23:
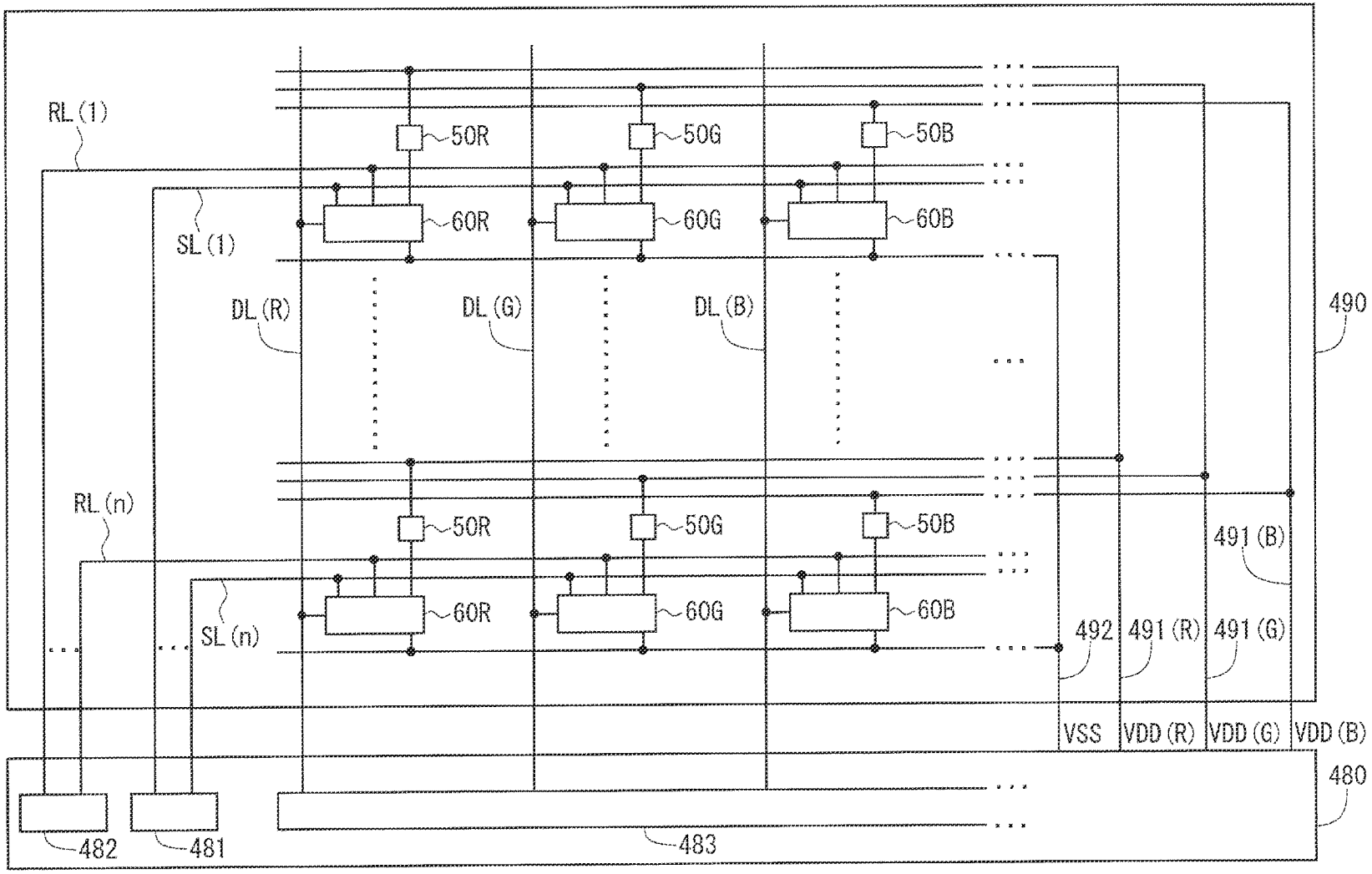
FIG. 23 is a block diagram for describing a schematic configuration of a display portion in the third embodiment.
Figure 24:
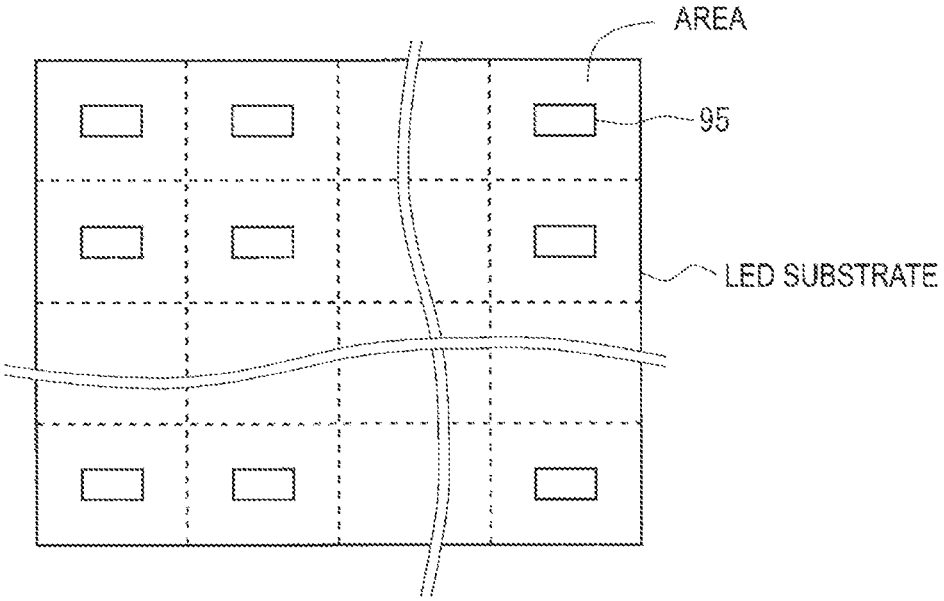
FIG. 24 is a diagram illustrating a direct backlight for performing local dimming in connection with a known example.
Figure 25:
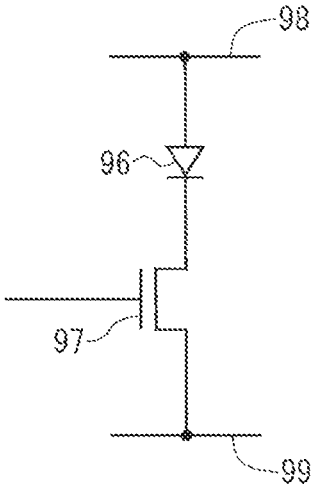
FIG. 25 is a diagram for describing a circuit portion in which an LED and a drive transistor are connected in series in connection with a known example.

FIG. 23 is a block diagram for describing a schematic configuration of the display portion 490 and the light source control circuit 480. The display portion 490 is provided with an LED unit including one or a plurality of LEDs and an area drive circuit configured to drive the LED included in the LED unit. Note that the red LED unit is denoted by reference sign 50R, the green LED unit is denoted by reference sign 50G, and the blue LED unit is denoted by reference sign 50B. The area drive circuit corresponding to the red LED unit 50R is denoted by reference sign 60R, the area drive circuit corresponding to the green LED unit 50G is denoted by reference sign 60G, and the area drive circuit corresponding to the blue LED unit 50B is denoted by reference sign 60B. One picture element includes one set of "red LED unit 50R, green LED unit 50G, and blue LED unit 50B", and such picture elements are arranged in a matrix shape in the display portion 490.

As the power supply line, in addition to a VSS wiring line 492, a red VDD wiring line 491(R) for supplying high level power supply voltage VDD(R) for driving the red LED to the red LED unit 50R, a green VDD wiring line 491(G) for supplying high level power supply voltage VDD(G) for driving the green LED to the green LED unit 50G, and a blue VDD wiring line 491(B) for supplying high level power supply voltage VDD(B) for driving the blue LED to the blue LED unit 50B are disposed on the LED substrate. The VDD wiring line is provided for each color because a forward voltage drop Vf of the LED differs among the colors. As in the first embodiment described above, the first write control lines SL provided for respective rows, the second write control lines RL provided for respective rows, and the data lines DL provided for respective columns are disposed on the LED substrate.

The light source control circuit 480 includes a first shift register 481 that drives the first write control lines SL, a second shift register 482 that drives the second write control lines RL, and a data line drive circuit 483 that drives the data lines DL as in the first embodiment described above.

3.3 Configuration and Operation of Area Drive Circuit

As the configuration of the area drive circuits 60R, 60G, and 60B, a configuration similar to that of the area drive circuit 60 according to the first embodiment described above is employed. The same applies to the operation of the area drive circuits 60R, 60G, and 60B. Still, in the present embodiment, the red LED unit 50R functions as a red pixel, the green LED unit 50G functions as a green pixel, and the blue LED unit 50B functions as a blue pixel, and a data line DL(R) is provided with a data voltage corresponding to a pixel value of the red pixel, a data line DL(G) is provided with a data voltage corresponding to a pixel value of the green pixel, and a data line DL(B) is provided with a data voltage corresponding to a pixel value of the blue pixel. With this configuration, an image is displayed on the display portion 490, with each of the LEDs of the respective colors emitting light at a desired luminance.

3.4 Effects

According to the present embodiment, the LED display device is realized that can suppress the occurrence of a luminance reduction in the frame period immediately after a sharp increase in the target luminance.

Although the disclosure has been described in detail above, the above description is exemplary in all respects and is not limiting. It is understood that numerous other modifications or variations can be made without departing from the scope of the disclosure. For example, in each of the above-described embodiments, the drive transistor 61 is an n-channel type MOSFET, but a p-channel type MOSFET may also be employed as the drive transistor 61.

While there have been described what are at present considered to be certain embodiments of the disclosure, it will be understood that various modifications may be made thereto, and it is intended that the appended claim cover all such modifications as fall within the true spirit and scope of the disclosure.

What is claimed is:

1. A light-emitting device using an LED as a light source, the light-emitting device comprising:

a plurality of LED units each including one or a plurality of the LEDs, the plurality of LED units being provided, on a substrate logically divided into a plurality of areas, corresponding to the plurality of areas in a one-to-one manner;

a plurality of area drive circuits each configured to drive the LED included in a corresponding one of the LED units, the plurality of area drive circuits being provided corresponding to the plurality of LED units in a one-to-one manner;

a plurality of first write control lines;

a plurality of data lines intersecting with the plurality of first write control lines;

a plurality of second write control lines corresponding to the plurality of first write control lines in a one-to-one manner;

a first power supply line configured to supply a first power supply voltage;

a second power supply line configured to supply a second power supply voltage; and a drive control circuit connected to the plurality of first write control lines, the plurality of second write control lines, and the plurality of data lines, and configured to control an operation of the plurality of area drive circuits such that the LEDs included in the plurality of LED units are driven on a row-by-row basis, wherein the area drive circuits each include a drive transistor connected in series to the LED included in the corresponding one of the LED units, between the first power supply line and the second power supply line, a first write control transistor including a control terminal connected to a corresponding one of the first write control lines and including a first conduction terminal connected to a corresponding one of the data lines, a first holding capacitor including one end connected to a second conduction terminal of the first write control transistor and including another end connected to the second power supply line, a second write control transistor including a control terminal connected to a corresponding one of the second write control lines and including a first conduction terminal connected to the one end of the first holding capacitor, and a second holding capacitor including one end connected to a second conduction terminal of the second write control transistor and to a control terminal of the drive transistor and including another end connected to the second power supply line, the drive transistor is a MOSFET, each of the area drive circuits has a first write period in which the first write control transistor and the second write control transistor are both maintained in an on state, a first write stop period in which the first write control transistor and the second write control transistor are both maintained in an off state, and a second write period in which the first write control transistor is maintained in the off state and the second write control transistor is maintained in the on state, the periods being provided in this order in one frame period from a point when the first write control transistor changes from the off state to the on state to a point when the first write control transistor next changes from the off state to the on state.

2. The light-emitting device according to claim 1, wherein each of the area drive circuits has a second write stop period in which the first write control transistor and the second write control transistor are both maintained in the off state, provided between an end point of the second write period in an earlier one of two consecutive frame periods and a start point of the first write period of a later one of the two consecutive frame periods.

3. The light-emitting device according to claim 2, wherein, of the first write period, the first write stop period, the second write period, and the second write stop period, the second write stop period has the longest length.

4. The light-emitting device according to claim 1, wherein an electrostatic capacitance value of the second holding capacitor is 1/10 of an electrostatic capacitance value of the first holding capacitor or smaller.

5. The light-emitting device according to claim 1, wherein each of the area drive circuits has an end point of the second write period in an earlier one of two consecutive frame periods, and a start point of the first write period of a later one of the two consecutive frame periods, the end point and the start point being same points.

6. The light-emitting device according to claim 1, wherein a length of the first write stop period is equal to or longer than a time required for an inversion layer to be formed in the drive transistor when a voltage applied to the control terminal of the drive transistor is changed from a voltage corresponding to a minimum luminance to a voltage corresponding to a maximum luminance, and a carrier density to become constant in the inversion layer.

7. The light-emitting device according to claim 1, wherein the first write control transistor and the second write control transistor are thin film transistors.

8. A display device comprising:

a display panel including a display portion configured to display an image; and the light-emitting device according to claim 1 provided on a back surface of the display panel and configured to illuminate the display portion with light.

9. An LED display device comprising:

the light-emitting device according to claim 1, wherein the plurality of LED units are classified into K types based on colors of light emitted, and each picture element includes the K types of the plurality of LED units.

* * * * *